United States Patent [19]

McClellan

[11] 4,303,286

[45] Dec. 1, 1981

[54] INSULATED FILING CABINET

[75] Inventor: Ralph E. McClellan, Toledo, Ohio

[73] Assignee: Meilink Industries, Inc., Whitehouse, Ohio

[21] Appl. No.: 115,676

[22] Filed: Jan. 28, 1980

[51] Int. Cl.[3] ..... A47B 88/00

[52] U.S. Cl. ..... 312/214; 312/107.5; 312/184; 312/330 R; 312/348; 220/22.3; 211/184; 109/58

[58] Field of Search ..... 312/111, 214–215, 312/222, 256, 314, 330, 339, 345, 348, 107.5; 109/58, 59, 79; 211/43, 184; 220/22.2–22.5

[56] References Cited

U.S. PATENT DOCUMENTS

| | | | |
|---|---|---|---|
| 2,312,611 | 3/1943 | West | 220/22.4 |
| 2,610,759 | 9/1952 | Stade | 220/22.3 |
| 2,750,901 | 6/1956 | McClellan | 312/214 |
| 3,647,101 | 3/1972 | Hersch et al. | 312/184 |
| 3,701,577 | 10/1972 | Fischer | 312/348 |
| 3,788,718 | 1/1974 | Bjorn et al. | 211/184 |
| 3,817,589 | 6/1974 | Anderson | 312/214 |
| 4,181,381 | 1/1980 | St. Amand | 312/184 |
| 4,201,429 | 5/1980 | Collier | 312/348 |

FOREIGN PATENT DOCUMENTS

| | | | |
|---|---|---|---|
| 394119 | 11/1965 | Switzerland | 312/184 |

*Primary Examiner*—Victor N. Sakran

*Attorney, Agent, or Firm*—Hugh Adam Kirk

[57] ABSTRACT

An improvement in R. E. McClellan's U.S. Pat. No. 2,750,901 issued June 19, 1956 to an Insulated Metal Cabinet Construction and its adaptation to lateral or wide shallow drawer insulated filing cabinets. The improvements include: a U-shaped sheet for three panels of the outer shell; reverse flanges at the edges of the outer shell panels; the reduction of welding spots by the use of adhesive in interfitting U-shaped channels between the jamb frame and the outer shell; formation of rail-supporting ribs in the inner shell panels; simplification of the structure and assembly of the jamb frame and its cross members; glass fiber reinforced insulation between the inner and outer shells; the addition of a telescoping slide on the bottom of the drawer, particularly for wide drawers to maintain their alignment and prevent them from becoming askew; simplification of the guide for the follower in the drawer by T-shaped anti-friction plastic slides; an adjustable frame of rails and half-partitions for drawers for hanger files; simplification and positive action of the bolt mechanism by reduction of springs and the inclusion of plastic bolts crimped in position on their slides; the adaptation of the bolt mechanism to be operated by either a twist or a pull-type handle on the front of the door; a bell crank and spring interlocking plunger attached to the bolt of a combination lock for spinning its dial and relocking the plunger; a fusible stop for releasing a supplemental door-locking bolt to prevent warping of the door in a fire; mounting of the drawer-locking pawl lever, a bell crank lever and a horizontal sliding plunger rod on a common demountable plate at each drawer; and separate vertically slidable locking bars on opposite sides of the drawers inside the cabinet for locking all the drawers by one key plunger lock on one drawer door, and for preventing the opening of more than one drawer at a time, particularly in wide drawer or lateral drawer-type cabinets to prevent them from tipping over.

25 Claims, 16 Drawing Figures

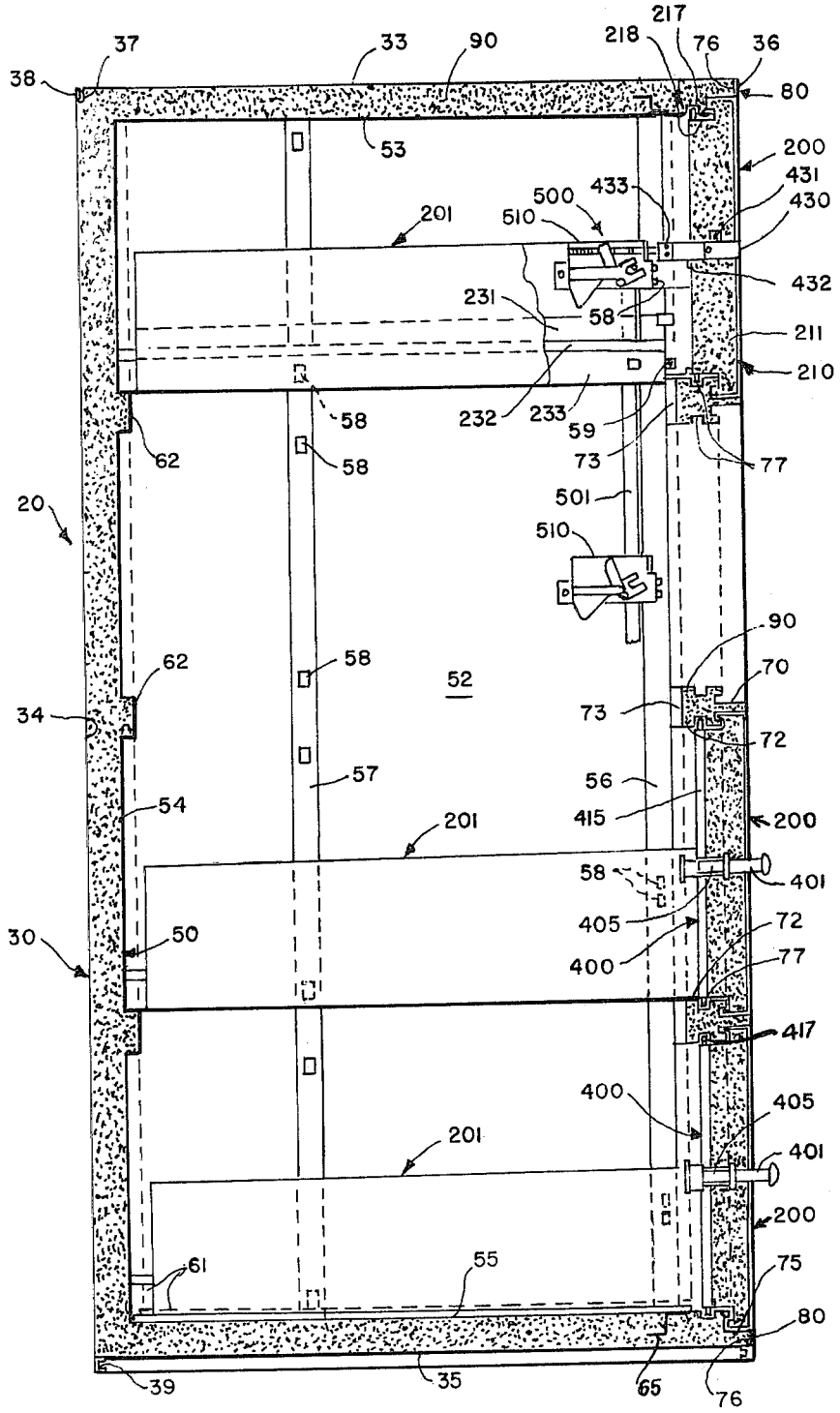
FIG. I

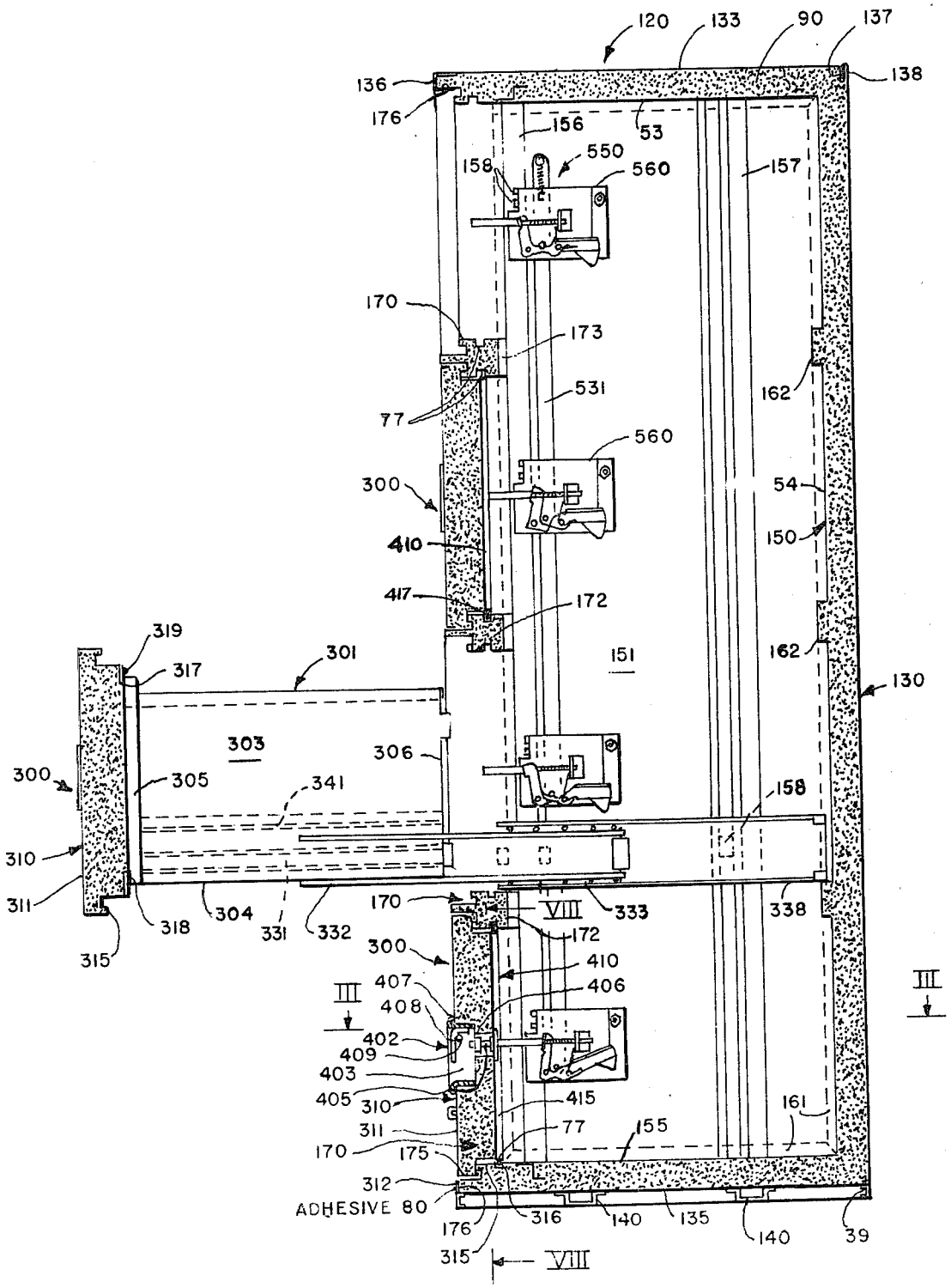
FIG. II

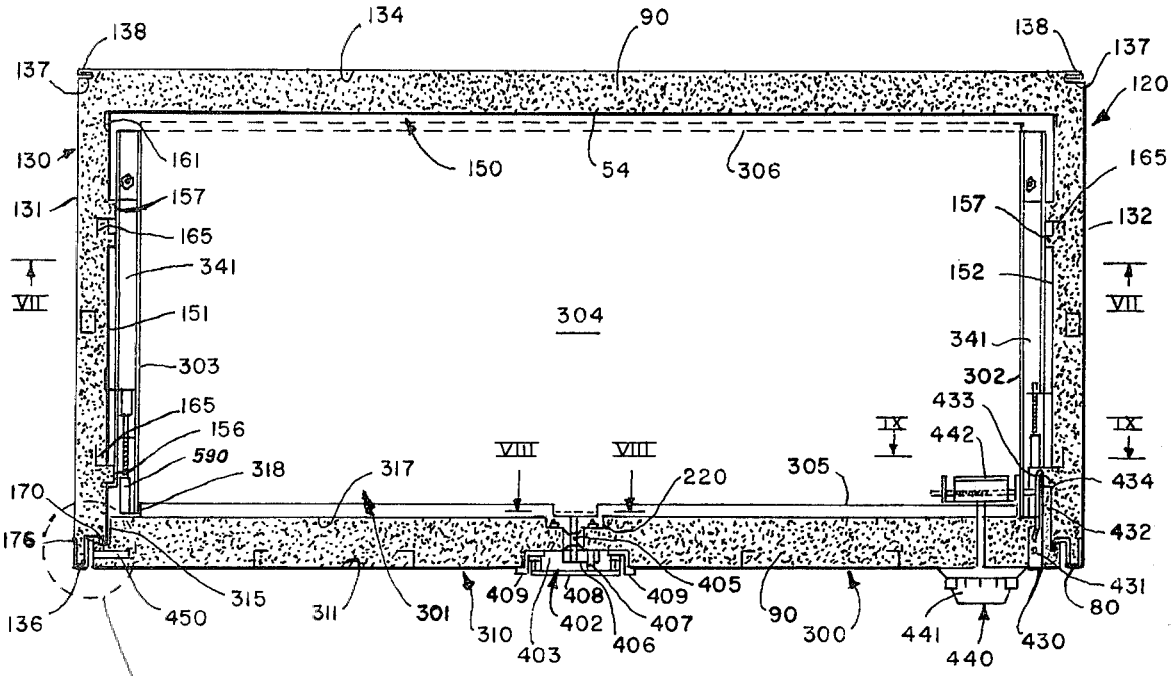
FIG. III
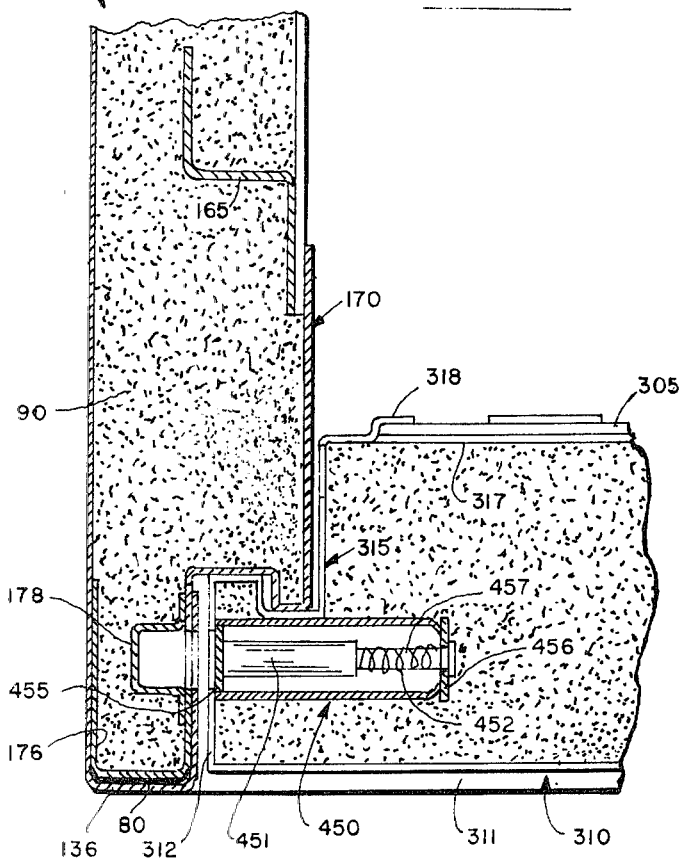
FIG. III A

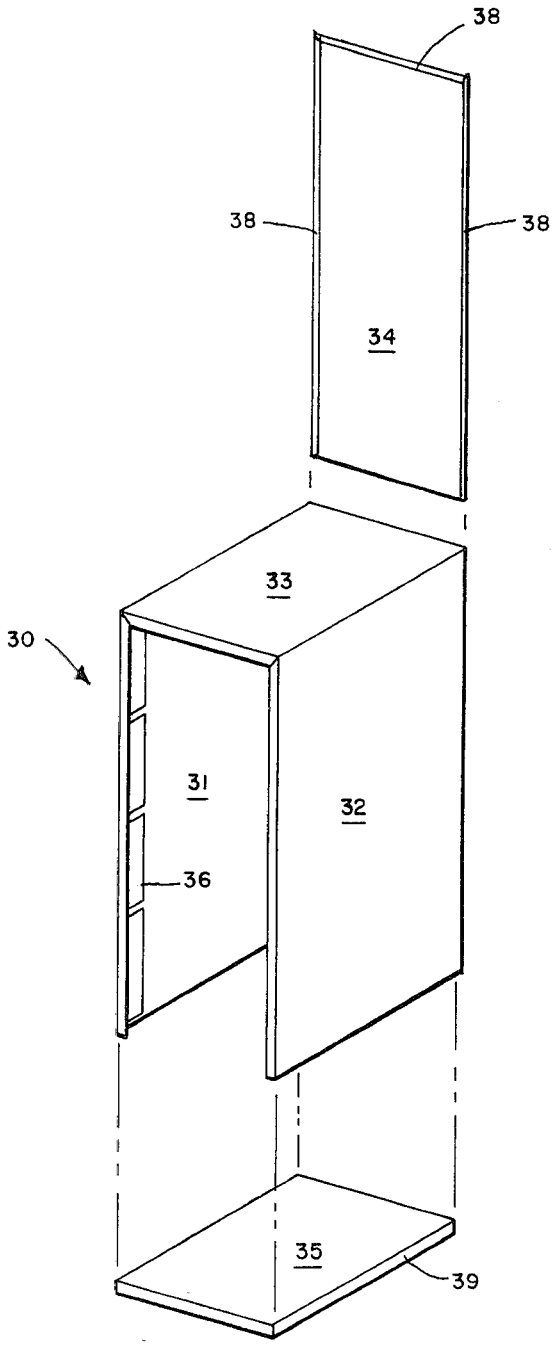
FIG. IV

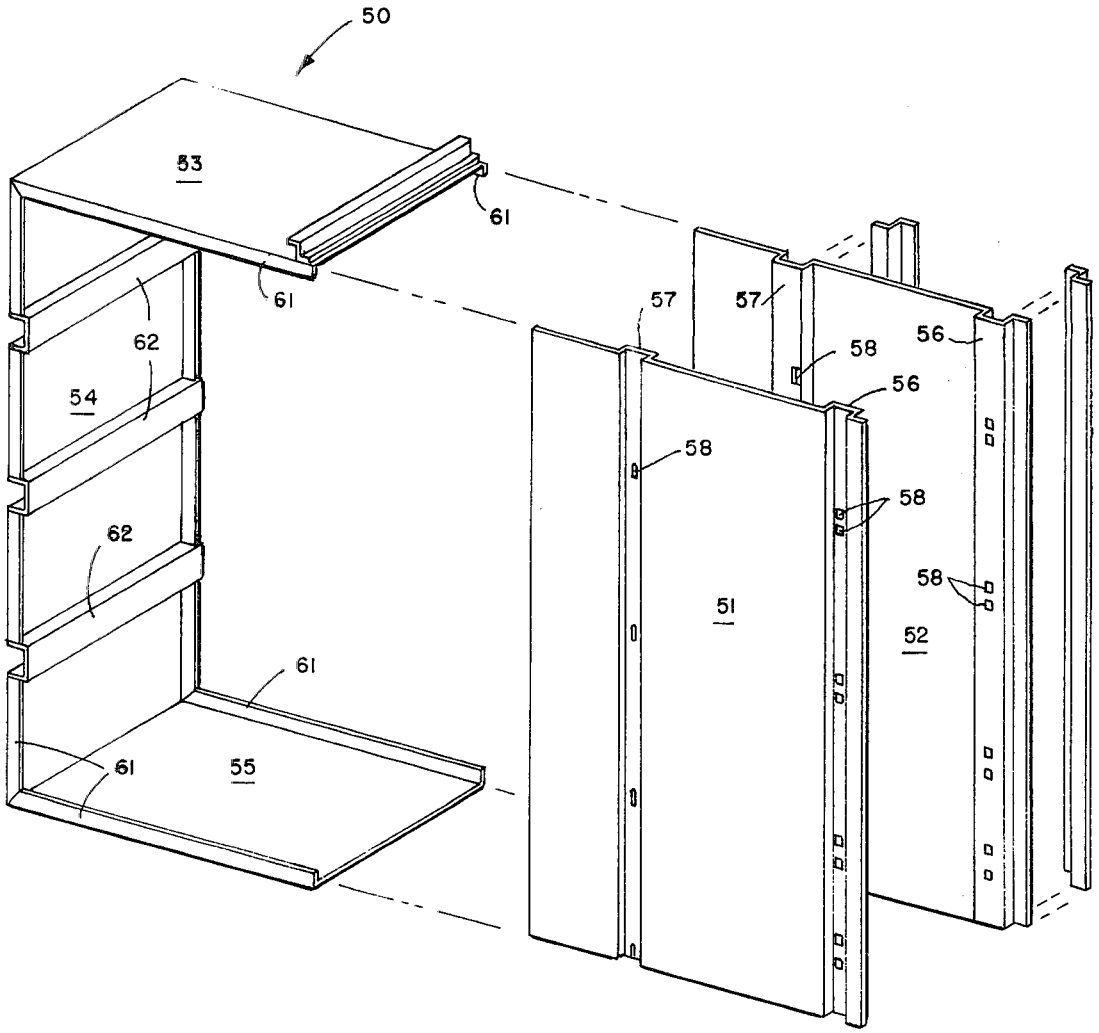
FIG. V

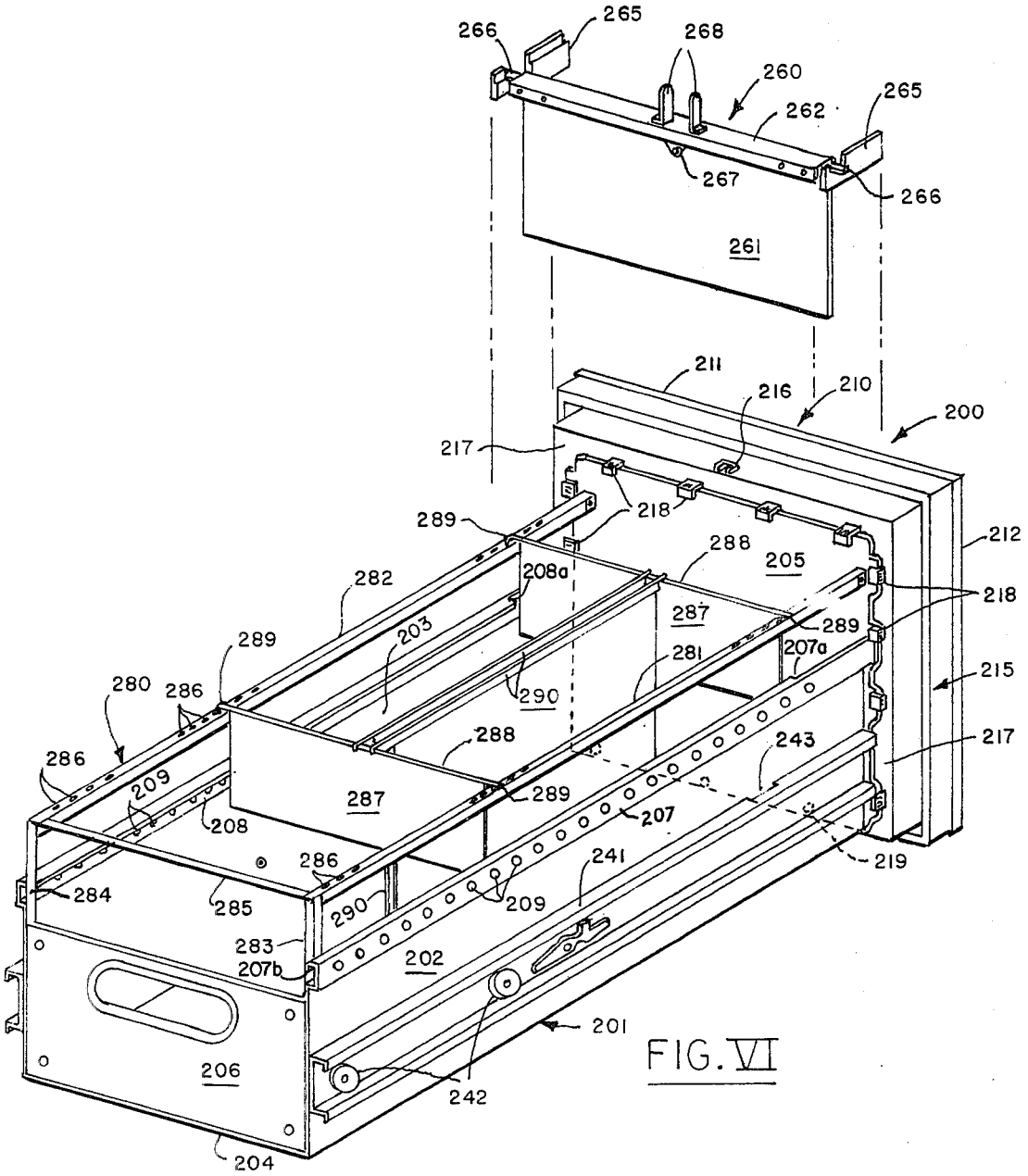
FIG. VI
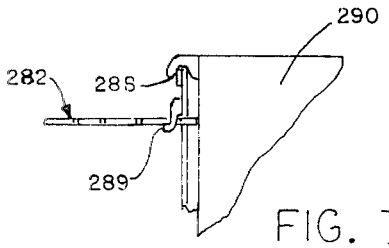
FIG. VI A

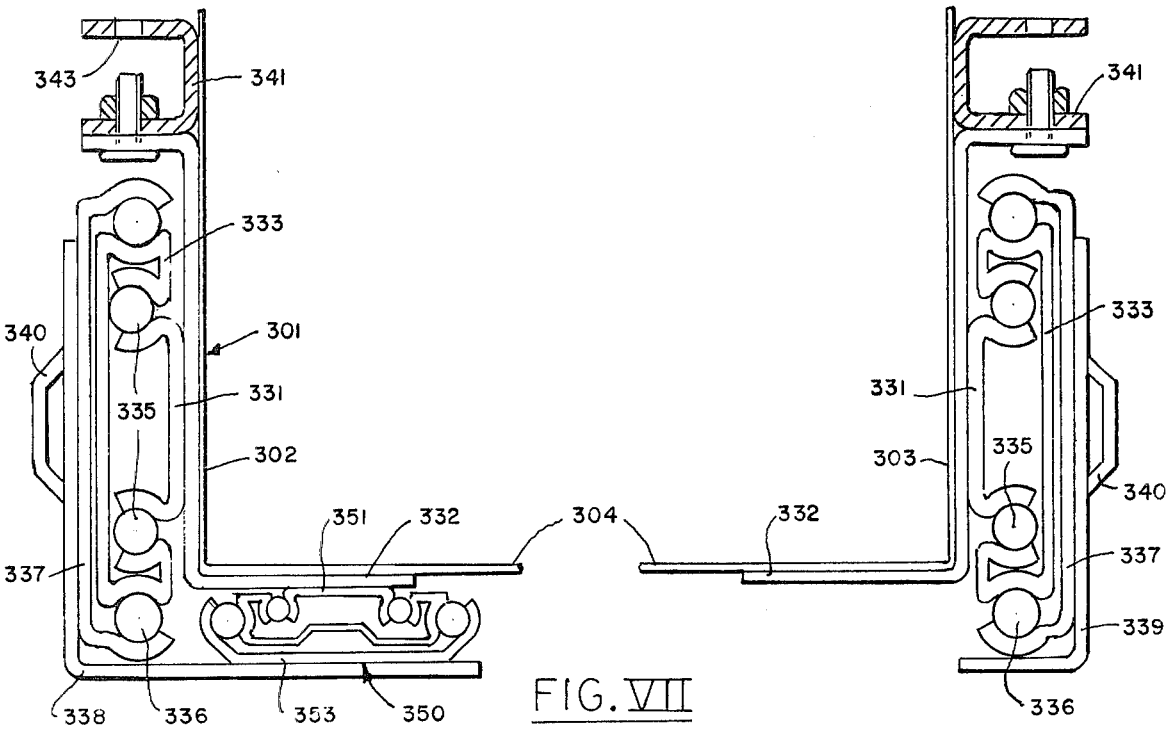
FIG. VII
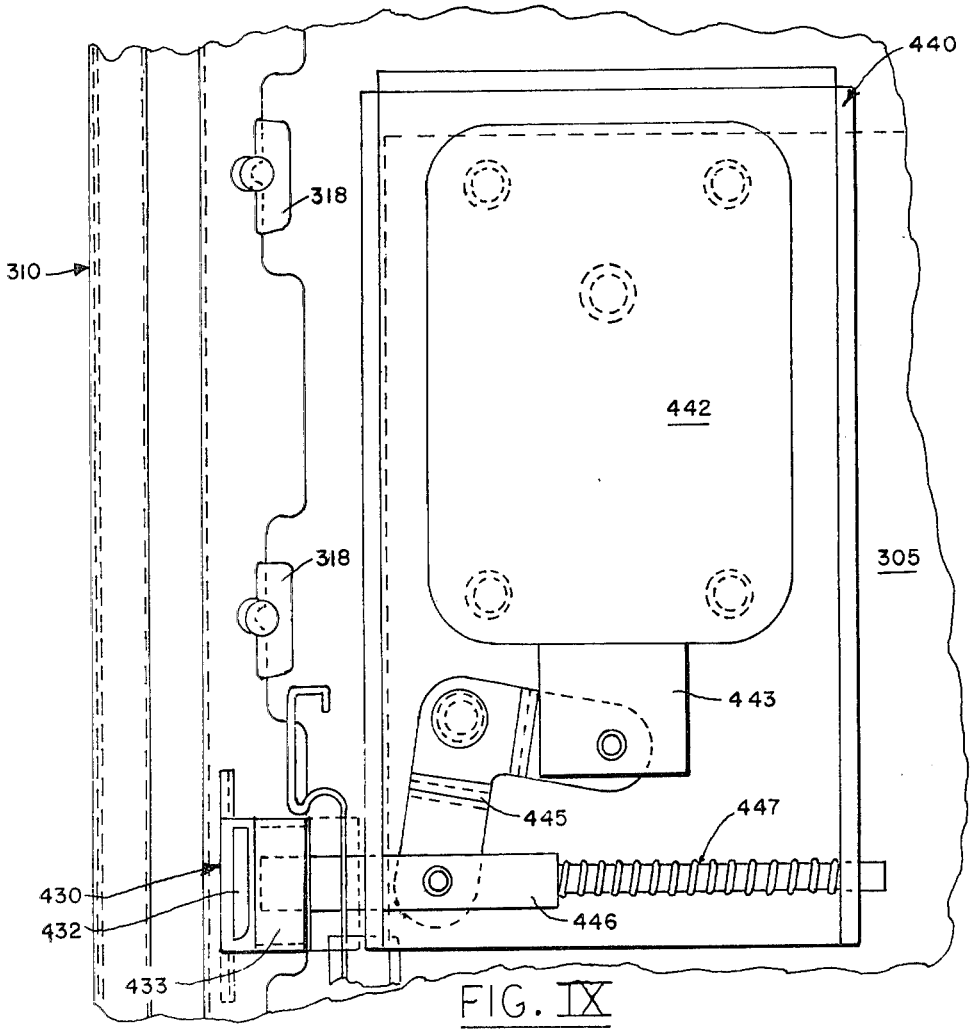
FIG. IX

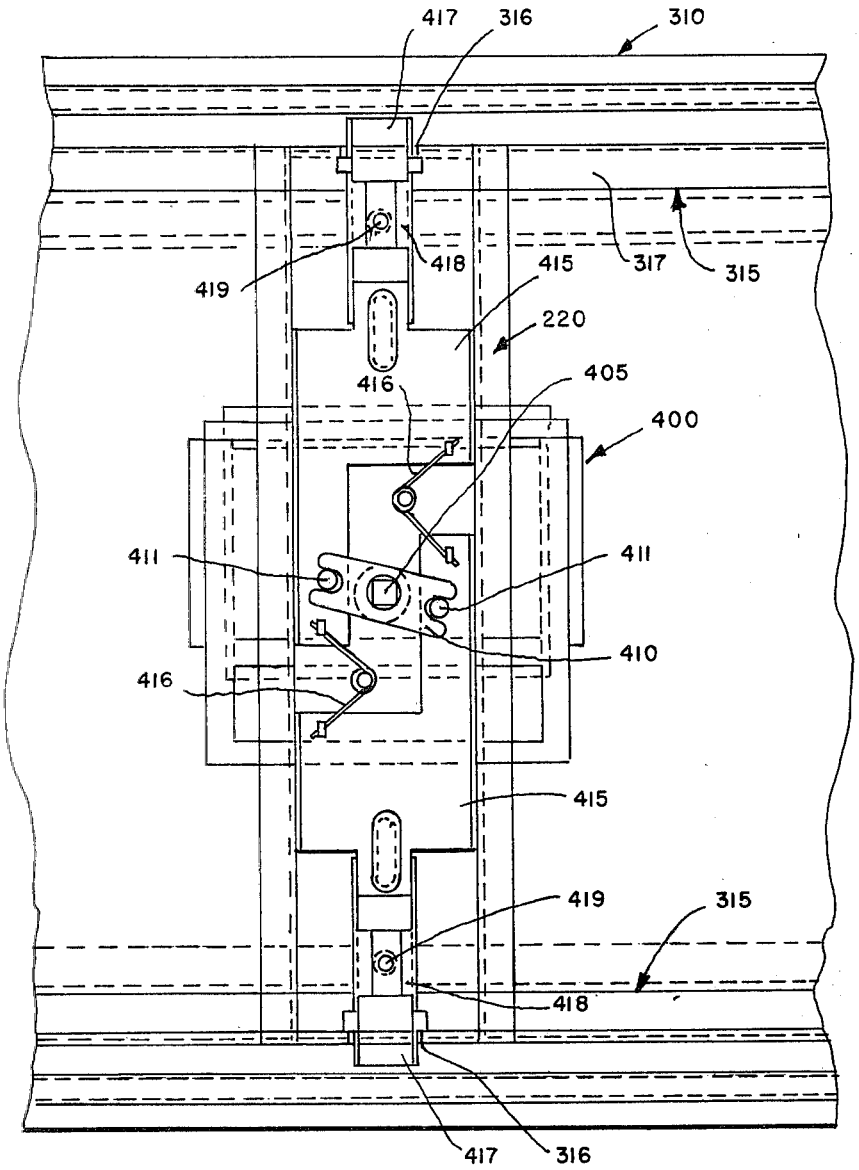
FIG. VIII
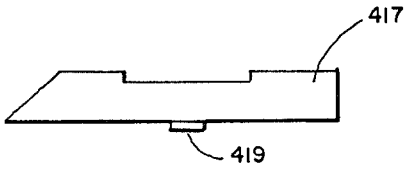
( PLASTIC LATCH BOLT )
FIG. VIII A

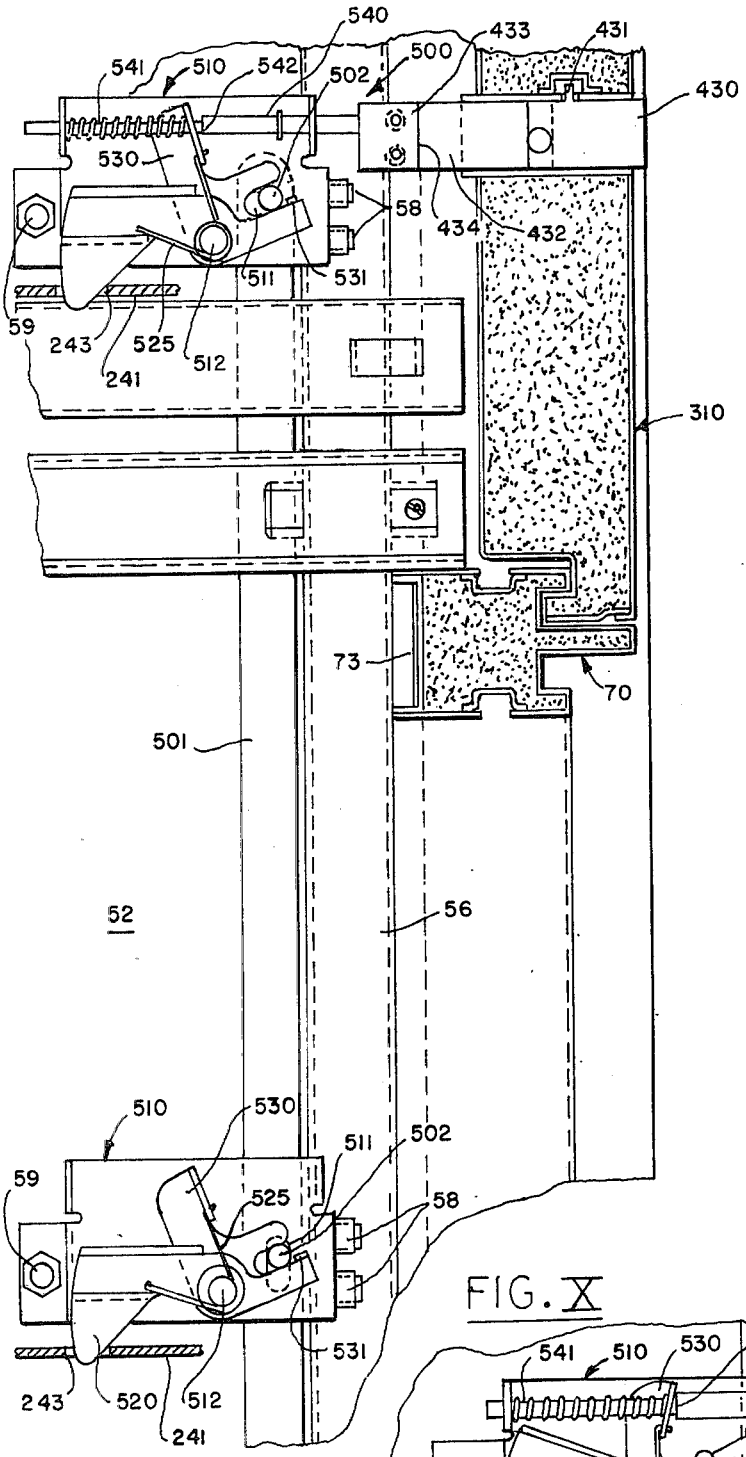
FIG. X
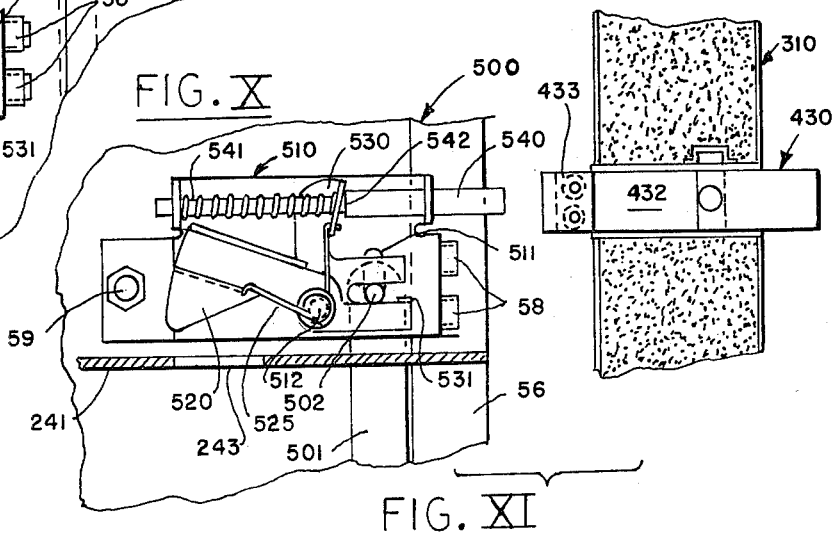
FIG. XI

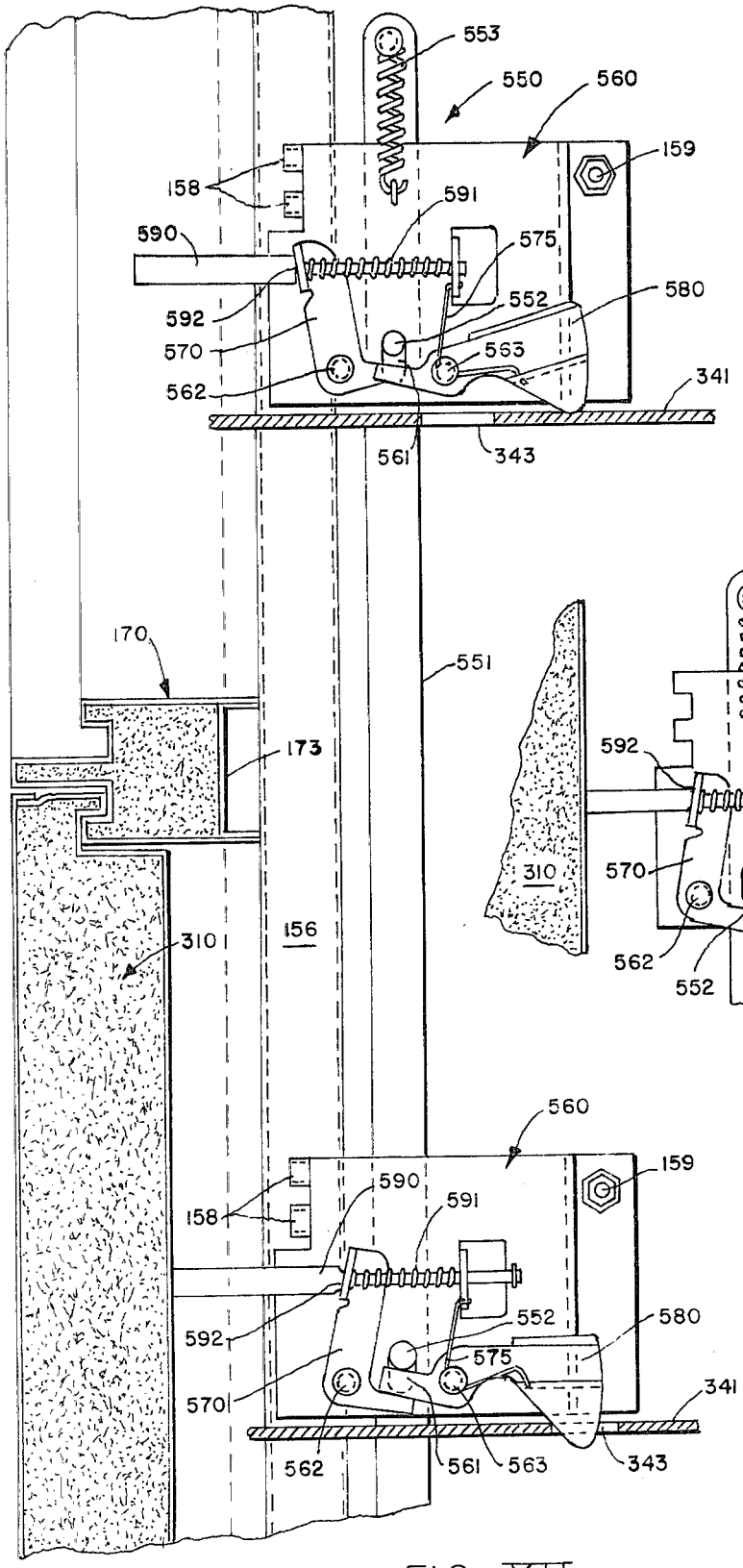
FIG. XII
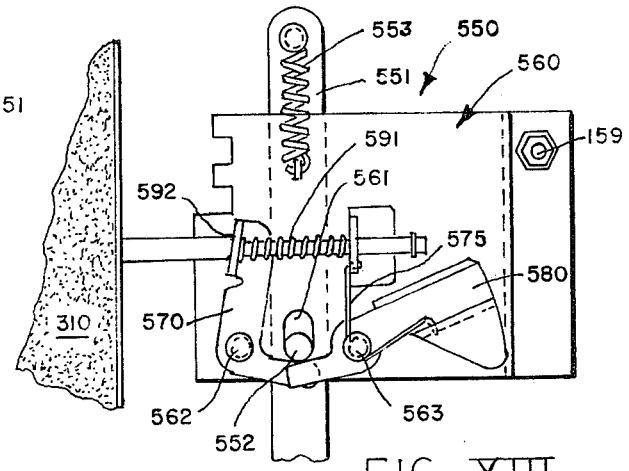
FIG. XIII

INSULATED FILING CABINET

BACKGROUND OF THE INVENTION

Applicant's prior patents and particularly his U.S. Pat. No. 2,750,901 discloses generally one type of an insulated filing cabinet including a plurality of latches and locking means having functions similar to those of the present invention. Besides what is disclosed in this McClellan patent, metallic shells having panels connected in U-shaped pieces are also known in

| | | | |
|---|---|---|---|
| Schriefer | 1,294,838 | February 18, 1919 | Class 109-58 |
| Walker | 1,543,349 | June 23, 1925 | |

and Schriefer also shows reverse bend edges flanges as does

| | | | |
|---|---|---|---|
| Gibson et al | 2,148,689 | February 28, 1939 | Class 109-82 |

The use of adhesives instead of welding for assembly of the sheet metal parts is taught by

| | | | |
|---|---|---|---|
| Schreyer | 3,391,967 | July 9, 1968 | Class 312-256 |

and insulation containing glass fibers is taught in

| | | | |
|---|---|---|---|
| Ganger et al | 3,709,169 | January 9, 1973 | Class 109-29 |
| Noone | 3,916,804 | November 4, 1975 | Class 109-78 |

Drawers for such filing cabinets having insulated front panels or doors that are easily moved therefrom are also shown in the above mentioned McClellan patent, and movable dividers and followers for the drawers are shown in

| | | | |
|---|---|---|---|
| Macrae | 590,666 | September 28, 1897 | Class 220-22.5 |
| Schmidt | 1,163,373 | December 7, 1915 | Class 220-22.3 |
| Rand | 1,948,935 | February 27, 1934 | Class 220-22.4 |
| Budai | 2,507,366 | May 9, 1950 | |
| Murray | 3,281,193 | October 25, 1966 | Class 211-46 |

The above mentioned McClellan U.S. Pat. No. 2,750,901 also discloses several different combinations of locking and latching means of the doors to drawers of filing cabinets, including a twist handle latch, a key plunger lock cooperating with a combination lock and vertically movable locking bar along both sides of the inner shell for gang locking and interlocking other drawers of the cabinet simultaneously. A pull handle for such cabinet drawers is shown also in the above mentioned Schreyer U.S. Pat. No. 3,391,967 and in

| | | | |
|---|---|---|---|
| Eland-Mantle | 2,427,386 | September 16, 1947 | Class 70-208 |

and a resettable combination lock is also shown in

| | | | |
|---|---|---|---|
| Ashton | 1,801,299 | April 21, 1931 | Class 70-314 |

In addition to means for simultaneously locking all of the drawers by a lock on a single drawer, there is also known means for interlocking the drawers so that more than one drawer cannot be opened at a time as shown in

| | | | |
|---|---|---|---|
| Latham | 3,883,200 | May 13, 1975 | Class 312-216 |
| Klenik, Jr. et al | 3,957,324 | May 18, 1976 | Class 312-218 |

Although many of the features of the present invention are broadly disclosed in the above mentioned patents, many of the improved features of the present invention are not disclosed, taught or predicted thereby, including the specific combination of the features of this invention, such as the reduction in the number of parts and welds required, the structure and shape of the shell edge flanges, the employment of anti-friction plastic parts for the door latches and follower slides, the easy interchangeability between pull and rotary door handles for operating the same latching mechanism, additional rail means for guiding drawers particularly for lateral or wide-drawer filing cabinets to maintain their alignment and prevent skewing, the adaptability of the locking levers and plungers for each drawer operated by a vertical locking bar so that the drawers can be interlocked and locked or not locked as desired by installation or removal of common standard plates having all the cooperating levers and plungers mounted thereon, and still other new and advantageous features described in the following description.

SUMMARY OF THE INVENTION

Since this invention not only comprises several dependent features for improving the insulated metal filing cabinet disclosed in McClellan's U.S. Pat. No. 2,750,901 issued June 19, 1956, but also new combinations of these features in such a cabinet, the description of this new cabinet is divided into three main parts, namely: (A) structure of the cabinet shell; (B) structure of the drawers and their doors for the cabinet; and (C) the locking and latching means for the drawers and doors in the cabinet.

(A) The improved features of this invention in the cabinet shell involve: forming of three panels of both the outer and inner shell from a single metal sheet, forming reverse flanges around the edges of these outer shell panels which not only act as retainers for an adhesive, but also channels for the telescoping of the panels together, and forming integral vertical lanced ribs on the inner side panels for supporting the drawer slides, locking plates and locking bars. More specifically the jamb frame is adhered to the front edge of the outer shell of the cabinet by interfitting U-shaped flanges at their peripheries which permits an adhesive to be held and used therein, thus avoiding the expense of welding the two parts together and thereafter the additional steps of grinding and polishing out the weld marks. Unexpectedly it has been found that these reverse flanges with the adhesive therein permits these flanges to spread to reduce the cracks between the doors and jamb frame when the cabinet is in a fire, thus further and better protecting the contents of the cabinet. Furthermore, the cross members of the jamb frame are already formed into tubular members before being so attached to the inner and outer shells of the cabinet. Such structures materially increase the ease and speed with which the shell of the cabinet may be assembled. Still further, the addition of glass fibers as reinforcement and filler in the concrete that is used for the insulation between the inner and outer shells of the cabinet, not only permits the reduction of some of the metal reinforcing strips and wire mesh between the shells as shown in the above mentioned McClellan patent, but also prevents cracking of the insulation even after a fire and drop test of the cabinet.

(B) In addition to removable mounting of the insulated door on each drawer and its telescoping side rails or slides, a telescopic rail or slide is also along the bottom of particularly the wider drawers to prevent them from coming out of alignment and/or jamming during opening and closing, thus improving the ease of their operation. The inner ends of each of the telescopic rails or slides are movably attached to the lanced tabs on the integral vertical ribs on the inner shell inside of the cabinet. The follower inside the drawer pan is supported and guided in antifriction T-shaped plastic slides for not only its movement and locking in parallel supporting channels along the top side edges of the drawer pan, but also to guide the opposite spring-urged pinchable locking bars on the top edge of the follower for locking it in a desired position in the holes along the said channels. Instead of the follower, around the rim of the drawer pan or on a framework comprising parallel rails, there may be provided predetermined apertures for positioning half-partitions suspended on and between the rims or rails, which half-partitions may have predetermined apertures along the rail top edges and hook means at the ends of their top edges for engagement in the apertures of their supporting rails, so that the drawer can easily be adapted for supporting either laterally or lengthwise different length hang files.

(C) The latching means for the doors of the drawers comprises a central twist or pull door handle for oscillating a lever for operating two oppositely positively and directly spring-urged bolt slides having antifriction plastic bolts crimpingly clamped therein for engagement in keepers in the jamb frame of the cabinet. The locking means for the doors and the drawers comprises a key plunger lock on at least one door, a cooperating vertical locking bar inside the cabinet, and separate spring panel, lever and plunger rod mounting plates for each drawer to engage keepers on the drawers adjacent their rails or slides to gang-lock the drawers, as well as combination lock for further locking the key plunger. A bell crank lever and spring plunger connected to the bolt of the combination lock twirls the dial of the combination lock each time the combination is found and the dial is released so as to remove automatically the last dial setting. Fusible supplemental locking bolt means also may be provided in the doors to prevent warping of the doors when in a fire. Furthermore, a drawer interlocking mechanism on the other side of the drawers from the gang-locking mechanism prevents more than one drawer being opened at a time. The improvements in the locking mechanism include a common pivot for the latch pawl and bell crank levers on their mounting plate, and in the interlocking mechanism two separately pivoted latch pawl and bell crank levers on their mounting plate. The separate gang-lock mounting plates provide easy adaptability for separately locking any one or combination of drawers in the cabinet. Thus the pushing in on the key plunger lock on the door when closed, abuts the associated horizontal plunger rod on the two lever mounting plates to rock the bell crank lever to raise the locking bar so that its pins at each drawer will correspondingly and simultaneously rock their bell crank levers and their separate locking pawl levers into their keepers on the rails of each drawer locking all the drawers. The locking pawl lever at each drawer also can be oscillated into its locking position or its keeper by the oscillation of its associated bell crank lever independently of the stack bar and its pin. The resilient operation of these levers permits the locking of the drawers even when one drawer is still left open so that it will automatically lock when it is closed. However, it is to be understood that one or more of the plunger rods or pins can be removed or eliminated from a mounting plate at one of the drawers for isolating that drawer from the gang-locking mechanism, as may be desired. On the other side of the drawers, when all the drawers are closed, all the locking pawl levers of the interlocking mechanism are disengaged from their keepers on the drawer slides, but as soon as one drawer is opened, all the other drawers are locked to prevent the opening of another drawer which could cause tilting of the cabinet. This is particularly advantageous in the lateral-type cabinets having wide drawers in that the depth of the cabinet does not have the stability for counterbalancing the weight of a fully-opened wide drawer.

OBJECTS AND ADVANTAGES

Accordingly, it is an object of this invention to produce a simpler, efficient, effective, economic, reliable, easy to assemble, durable, fire- and heat-resistant improved insulated filing cabinet.

Another object is to produce such a cabinet which eliminates much of the previous welding, grinding, and metal-finishing required for similar prior art cabinets and which seals the contents thereof better in the event the cabinet is in a fire by permitting the joints to spread and further close the cracks between the doors and their jambs, as well as providing additional means for locking the doors to reduce warping, which additional locks are triggered by the increase in temperature surrounding the doors.

Another object is to provide a positive direct, noiseless, smooth-acting, and simple bolt latching means for the doors of such a cabinet which will not unlatch to open the doors if the cabinet is ever dropped.

Another object is to provide a door for such a cabinet in which the handle for opening the latch bolts can be readily adapted to either a twist or a pull handle, as desired, without changing the latching mechanism.

Another object is to provide a simpler construction for the drawer of such a cabinet, which drawer is adaptable for a simple, low-friction and positively-operated follower, and for the easy installation of an adjustable frame for hang files.

Another object is to provide additional telescopic slide rail means for the drawers, particularly lateral or wide drawers, to prevent their skewing and to maintain them always in alignment regardless of where they are pushed or pulled for their opening and closing.

Still further object is to improve and simplify the gang-locking and interlocking mechanisms between the drawers so that they can be easily modified for selecting different drawers for separate or gang locking.

BRIEF DESCRIPTION OF THE VIEWS

The above mentioned and other features, objects and advantages, and a manner of attaining them are described more specifically below by references to embodiments of this invention shown in the accompanying drawings, wherein:

FIG. I is a vertical section of one embodiment of a four-drawer vertical insulated filing cabinet with the second drawer removed and parts broken away for showing part of the gang-locking mechanism between the drawers;

FIG. II is a vertical section similar to that of FIG. I of a lateral or wide four-drawer vertical insulated filing cabinet with the top drawer removed and the third drawer fully opened for showing the drawer interlocking mechanism on the other side from the gang-locking mechanism inside of the filing cabinet;

FIGS. III and III-A is a section taken along lines III—III of FIG. II showing other features of the construction of the cabinet and drawer including a pull handle and combination lock on the front of the drawer door; and in FIG. III-A an enlargement of the lower left corner of FIG. III;

FIG. IV is a perspective exploded view of the panels of the outer shell of the cabinet shown in FIG. I;

FIG. V is a perspective exploded view of the panels of the inner shell of the cabinet shown in FIG. I;

FIGS. VI and VI-A is an enlarged perspective view of one of the drawers from the cabinet shown in FIG. I showing a follower ready for installation therein and having installed in the drawer pan a rail frame and three half-partitions for supporting different length hang files hang folders; and FIG. VI-A showing an enlargement of the hook end of one half-partition;

FIG. VII is an enlarged sectional view taken along lines VII—VII of FIG. III with parts broken away showing one embodiment of telescopic slides or rails for supporting and guiding a wide drawer in and out of a cabinet including a telescopic rail or slide along the bottom of the drawer;

FIGS. VIII and VIII-A is an enlarged view taken along lines VIII—VIII of FIGS. II and III showing the latching bolts behind the drawer door; and FIG. VIII-A a side view of the plastic latch bolt per se;

FIG. IX is an enlarged view taken along lines IX—IX of FIG. III showing the back of a combination lock and a bell crank lever connected to a spring-urged plunger for locking the key plunger lock on the door;

FIG. X is an enlarged view of the top two plates of the drawer gang-locking mechanism of the cabinet in FIG. 1 operated into their drawer-locking positions by the key plunger lock on the top door drawer;

FIG. XI is a view similar to FIG. X showing the upper plate in FIG. X in its unlocked position with its associated drawer open;

FIG. XII is an enlarged view of the top two plates of the drawer interlocking mechanism shown in FIG. II showing the top drawer open and the other door locked closed; and FIG. XIII is an enlarged view similar to FIG. XII of one of the plates of the drawer interlocking mechanism in its unlocked position when all the drawers are closed.

DETAILED DESCRIPTION OF PREFERRED EMBODIMENT

A. The Cabinets Per Se and Their Shells

Generally speaking, FIGS. I and II show sections through completely assembled four vertical drawer insulated file cabinets 20 and 120, the former cabinet 20 of which has narrow long drawers 200 and a corresponding cabinet shell as shown in FIGS. I, IV and V, while FIGS. II and III have wide or lateral drawers 300 and a correspondingly wide cabinet shell. Each of these cabinets 20 and 120 have outer shells 30 and 130, inner shells 50 and 150 between which shells is provided insulation 90. The size of the panels which make up the inner and outer shells of both cabinets 20 and 120 differ not only as to the length or width relative to the size of the drawers that fit therein, but also may vary in size relative to the number of drawers in each cabinet which may vary from one up to four or more. However, the structure of the elements on these panels such as their flanges and ribs, are substantially the same in all such cabinets. This is also true for the general features of the drawers and their insulated doors at one end thereof, as well as the types of locks, latches and handles which are provided in each cabinet, including the gang drawer locking mechanism which is shown in part in FIG. I on one inside wall of the cabinet 20 and the drawer interlock mechanism shown in FIG. II on the other inside wall of the cabinet 120. It is to be understood that the opposite inside walls of both of these cabinets are designed so as to provide for both the drawer gang-locking and drawer interlocking mechanisms. Thus in the description which follows, it should be kept in mind that the details described for one type cabinet are readily adaptable and applicable to the other size and shape cabinets.

A-1. The Outer Shell

Referring now to FIGS. I, II, III and IV, the outer shells 30 and 130 comprise two complimentary side panels 31 and 32 or 131 and 132, top panel 33, 133, a back panel 34, 134 and a bottom inverted tray panel 35, 135. For the narrow long drawer filing cabinet shown in FIGS. I and IV, the two side and top panels may be formed of one large sheet bent into the form of an inverted "U". However, for the wide drawer panel, the sheets this long for a four-drawer cabinet are not standard and therefore the top panel 133 for the embodiment shown in FIGS. II and III usually is a separate inverted tray-shaped panel similar to that of 35 shown in FIG. IV. Both the front and rear edges of the two side and top panels 31, 32, 33 or 131, 132, 133 are provided with reverse flanges; the front edge having a reverse flange 36 or 136 with the outer flange portion parallel with that of the panel from which it was made, thus forming a flange of U-shaped cross section with the base of the "U" forming a border for the front of the cabinet. The rear edge of the top and two side panels 31, 32, 33 or 131, 132, 133 also have a reverse flange 37 or 137 but at right angles to the surface of the panels with the U-shaped cross section opening outwardly as shown in FIGS. I and II for the top panel 33 or 133 and in FIG. III for the side panels 131 or 132. The back panel 34 or 134 is also provided with a reverse flange 38 or 138 on its two sides and top edges so as the back panel will slide into position in these interfitting reverse flange channels 37 or 137 from the position shown for the back panel 34 in FIGS. IV, downwardly after the outer and inner shells 35 and 50 or 130 and 150 and insulation 90 have been assembled. In order to complete the outer shell, the bottom panel 35 or 135 is usually welded to the bottom edges of the side panels 31 and 32 or 131 and 132 on its peripheral flange 39, which bottom panel 35 or 135 may be reinforced by welded channel strips 140 as shown in FIG. II for the wide or lateral drawer cabinet 130.

A-2. The Inner Shell

Referring now to FIGS. I, II, III and V, the inner shell 50 or 150 comprises two side panels 51 and 52 (see FIG. V) or 151 and 152, a top panel 53 or 153, a back panel 54 or 154, and a bottom panel 55 or 155. The two side panels 51, 52 or 151, 152 are each provided with integral vertical ribs 56 and 57 or 156 and 157, which ribs are provided with lanced offset loops 58 or 158 adjacent each drawer 200 or 300. Also there may be provided as shown in FIGS. X through XIII threaded or threadable studs 59 or 159 welded to these panels 51, 52 or 151, 152 adjacent these lanced loops 58 or 158. The top, back and bottom panels 53, 54, 55 or 153, 154, 155 are herein formed from a single metal sheet formed into a "U" shape and are provided with right angle inwardly extending flanges 61 and 161 around their edges, inside of which flanges the associated edges of the two side panels 51, 52 or 151, 152 telescope or slide as shown in FIG. V. If desired, the vertical ribs 56, 57 or 156, 157 on the inner side panels 51, 52 or 151, 152 may have welded thereto toward the space between the inner and outer shells 30 and 50, reinforcing strips 65 or 165 as shown in FIG. III. Transversely across the rear inner panel 54 or 154 there are provided ledge channels 62 or 162 corresponding with each of the drawers and the lanced loops 58 or 158 on the vertical ribs 56, 57 or 156, 157 of the side panels 51, 52 or 151, 152.

A-3. The Door Jamb Frame

Mounted on the front open ends of the assembled inner shell 50 or 150 is provided a rectangular stepped jamb frame 70 or 170 which has a peripheral reverse flange 76 or 176 and cross tubular frame members 72 or 172 corresponding to the spaces between the drawers and horizontally parallel and aligned with the rear panel ledge channels 62 or 162. These tubular cross members 72 or 172 and the periphery of the frame 70 or 170 are stepped in their cross-sectional configuration for interfitting with corresponding stepped configurations around the edge of the doors of the drawers 200 and 300. These tubular channels 72 or 172 are closed at their rear sides by channel strips 73 or 173 as shown in FIGS. I and II, and the inner ends of the inner periphery of the frame 70 or 170 is welded to the front edge of the two side panels 51, 52 or 151, 152 and of the top and bottom panels 53, 55 or 153, 155. Thus when the inner shell 50 or 150 with the door jamb frame 70 or 170 has been assembled, its outer peripheral reverse flange 76 or 176 is seated or fitted inside of the reverse flange 36 or 136 and anchored (see FIG. III-A) together by means of a metal adhesive 80. Thus the reverse flange 36 or 136 on the outer shell 30 or 130 may be coated or applied with an adhesive such as an organic polymer type, and its catalyst to set it up may be applied to the outside of the reverse flange 76 or 176 just before these interfitting reverse flanges are nested together. This method of assembly by means of and adhesive reduces materially the labor required in welding the inner and outer shells together and after the welding, the additional labor of grinding and finishing off the welds on the outer surface of the outer shell. If the cabinet so assembled is in a fire, this organic adhesive burns out and permits the U-shaped flanges to straighten out to close the stepped gaps between the jamb frame and the edges of the doors, even more firmly to protect better the contents of the filing cabinet.

For closing the bottom front of the cabinet there may be provided a separate strip 75 or 175 of "L"-shaped cross-section shown in FIGS. I and II which also may be adhered by the adhesive 80.

A-4. The Insulation

In the spaces between the inner and outer shells 30, 130 and 50, 150 and in the tubular portions 72 or 172 of the jamb frame 70 or 170, there is poured and filled a cement 90, preferably light in weight, such as having a filler of vermiculite, to insulate the inside of the cabinet from excess heat in the event of a fire outside the cabinet. This cement 90 has the advantage that during the fire, water is released from its chemical composition of crystalization or setting-up which produces steam and forms a protective atmosphere inside the cabinet to prevent charring of the papers therein. It has been found that if in addition to the vermiculite, glass fibers are also employed in the mix as a filler, that the screen or wire mesh which was previously used in this space between the shells to prevent cracking of the insulation, may be eliminated and that a much stronger shock-resistant insulation is produced, which even in a fire and drop test does not crack to open up pores for the entrance of heat for the deterioration of the contents of the cabinet. Thus with glass fibers added to the cement 90, a much better insulated cabinet is produced, which is more fire and drop-resistant.

B. The Structures of the Drawers and Their Insulated Doors

Referring primarily to FIG. VI which shows a drawer 200 in perspective and removed from the cabinet 20, it is to be understood that similar structures are also involved in the drawers 300 from the cabinet 120; however, there may be minor distinctions between these two drawers, such as the types of rails or slides used for supporting and guiding their movements and the type of connection between the insulated door 210 or 310 and drawer pan 201 or 301.

B-1. The Drawer Pan

Both the longitudinal and wide or lateral drawer pan 201 and 301 comprises a pair of parallel sides 202, 203 and bottom 204, or 302, 303 and 304, which preferably are made out of a single piece of sheet metal forming a U-shaped piece. The ends of this U-shaped piece or channel of the pan 201 or 301 are provided with separate front and rear end panels 205, 305 and 206, 306, respectively, each of which are either welded, bolted, or otherwise attached to the sides and/or bottom of the drawer pan 201 or 301.

B-2. The Insulated Door

The insulated front or door 210 or 310 to the drawers 200 or 300 comprises a front panel 211 or 311 with a peripheral flange edge 212 or 312. Welded to this flange 212 or 312 is an integral rectangular stepped frame 215 or 315 having steps which interfit with the steps on the jamb frame 70 or 170 of the cabinet. The center top and bottom of this frame are provided with apertures 216 or 316 for protrusion of the bolts 417 that latch the doors 210 or 310 closed. On the inner flange 217 or 317 of this frame 215 or 315 are provided a plurality of lanced tabs 218 as shown in FIG. VI or there are provided flanges 318 as shown in FIGS. II and III into which tabs or flanges the edges of the front end panel 205 or 305 of the drawer pan 201 or 301 slide relatively to each other and then they are anchored together either by screws 219 at the bottom through the front panel 205 into the flange 217 after the door 210 is slid down over the pan front end panel 205 or by screws 319 along the top of the drawer door as shown in FIG. II for the pan 301 that is slid down onto the door 310.

The doors 210 or 310 are also provided on their inner surface with a vertical channel 220 centrally of the frame 215 or 315 (see also FIG. VIII) into which channel are mounted and guided the door latch bolts slides and mechanism described below in section C-1. The ends of this channel 220 are preferably welded to the inner flange 217 or 317 of the frame 215 or 315.

B-3. The Telescopic Slides or Rails

Along opposite sides 202, 203 or 302, 303 of the door pans 201 or 301, and usually along the lower edges or corners thereof, there are provided rails or slides for supporting and guiding the drawers 200 or 300 in and out of their closed and open positions, respectively. These rails or slides may take several different forms of which three different forms are shown in the drawings. In every case these slides are telescopic rails guided by rollers or ball bearings, preferably comprising at least three sections, one end section of each telescopic slide being rigidly attached to the drawer 201 or 301 while the other section of the telescopic section is attached to the inner shell 50 or 150 of the cabinet.

The telescopic rail sections shown in FIG. I comprise an upper rail section 231 attached to the side of the drawer pan 201 which section 231 is surrounded by an intermediate section 232 journalled in ball bearings which also surrounds a lower rail section 233. This latter section 233 is attached to the inner shell 50 by means of the lanced tabs 58 on the vertical ribs 56 and 57 and rests at its inner end on the transverse ledge channels or ribs 62 and is held in position by a nut on a stud 59. Thus the telescopic slides are removably anchored to the cabinet so that any drawer and its slides can easily be removed for repair or replacement as desired or when required.

Another embodiment of these telescopic slides or rails is shown in FIG. VI in which the drawer attached section 241 is journalled in rollers 242 instead of ball bearings. This slide also contains near one end thereof a keeper aperture 243 which may be located in a separate strip attached to the slide or the drawer.

Still another embodiment of the telescopic slides is shown in FIGS. II, III and VII in which the three separate telescoping sections surround each other and are journalled in ball bearings. In this embodiment (see FIG. VII) the telescopic movable sections 331 are welded or otherwise attached to "L" channel or strip brackets 332 which in turn are bolted to rails 341 which in turn are welded to the drawer pan 301. The intermediate telescopic sections 333 are slidably journalled in ball bearings 335 and 336 in the inner and outer telescoping sections 331 and 337, respectively. The outer telescopic stationary section 337 on at least one side of the drawer is rigidly attached to another "L" channel or strip bracket 338, while the other side section 337 may be attached to a narrower bracket 339. Each of the brackets 338 and 339 are provided with lanced tabs or portions 340 for interfitting with the lanced tabs 158 on the vertical rails 156 and 157 and with their inner ends supported on the ledge ribs 162 in the back panel 154 in a similar manner as for the telescopic slides described for the cabinet 20 above. Attached to the one and preferably both of the L-brackets 332 is a keeper rail 341, each with a keeper aperture 343 for cooperation with the drawer locking mechanism described below in Section C-4.

In this embodiment for the wide or lateral drawer cabinet 120 there is also provided the additional horizontal telescopic slide 350 whose movable and stationary end sections 351 and 353 are respectively welded or otherwise attached to the L-brackets 332 and 338 so that this telescopic rail 350 extends along the bottom 304 of the drawer pan 301 and operates at right angles to the or in a plane orthogonal to the parallel planes of the other two vertical telescopic rails or slides. The reason for this additional telescopic slide is to maintain the alignment of the wide drawers 300 so that they will not become askew or jam if an operator tends to push on one side or end of the wide drawer in preference to another. It is to be understood, however, that this third telescopic slide 350 may be independently mounted and may be provided for each side of the drawer 300 or also may be provided for the narrower drawers 200 shown in the other embodiment 20 of the cabinet of this invention.

B-4. The Follower

Referring back to FIG. VI there is shown removed from and above the front end of the drawer pan 201, a follower 260 which slides into the generally U-shaped channels 207, 208 formed integrally along opposite upper edges of the sides 202, 203 of the drawer pan 201. The guiding channels 207, 208 have complementary U-shaped cross-sections, except for their ends adjacent the door 210 where the upper flanges or legs are absent at **207*a* and 208*a* so that the follower can be removed easily for repair, replacement or as desired. At regular intervals all along these channels 207 and 208, in the base of the "U", are apertures 209 into which the bolt-type ends of pinch bars 266 on the follower 260 can engage for anchoring this follower in different positions along the length of the drawer pan. The follower 260 comprises herein a vertical panel, partition or keeper portion 261 which has a reverse flange channel 262 along its upper edge into the open ends of which channel 262 are anchored T-shaped antifriction molded plastic guides or slides 265 with grooves for supporting the two bolt bars 266. At least one of the legs of the U-shaped channels 207, 208 has a groove or inwardly extending portion such as flange 207*b* to retain the guides or slides 265 and prevent the drawer sides 202, 203 from spreading. The two bolt bars 266 are urged in opposite outward directions by a central spring 267 into oppositely horizontally aligned apertures 209 in the channels 207, 208. The inner ends of these bolt bars 266 are stepped upwardly for holding them in their slots in the top of the channel 262, as well as to provide pinching handles 268 for their retraction from the apertures 209 and against the action of the spring 267 to permit sliding adjustment of the follower 260 along the channels 207, 208**.

B-5. File Hanger Frame

Referring still to FIG. VI, there is also shown in the drawer pan 201 a separate frame 280 which comprises a couple of parallel horizontal rails or bars 281 and 282, the ends of which rails or bars are removably fastened to the inside of the front end 205 of the drawer pan 201 and the opposite ends of which are supported on separate vertical posts 283 and 284 which may be bridged by a similar apertured cross-rail or bar 285 and which posts are removably attached to the rear corners of the drawer adjacent the back panel or end 206. These rails 281 and 282 are provided with predetermined spaced apertures 286 and between these rails are connected half-partition members 287 which have similar apertured top rail edges 288 with hooks 289 (see FIG. III-A) at their ends for engagement in the apertures 286 in the rails 281, 282 and 288 for anchoring the partitions 287 in different positions corresponding to the length of the letters and hanger files 290 which are to be supported between spaced parallel pairs of such rail portions 281, 282, 285 and 288. Thus by including a frame 280 and a plurality of partial partitions 287, the drawer shown in FIG. VI or the wide drawer 300 shown in FIG. III, may be divided for different size letter and hanger files 290 as may be desired. The frame 280 and its rails and portions 287 are already pre-apertured 286 for locating the partitions 287 for all of the different length standard hanger-type files 290 that are to be supported on the frame.

Instead of this frame 280, the top edges or rim of the drawer pan 201 or 301 may be adapted for supporting and/or locating the half-partitions 287.

C. The Latching and Locking Mechanisms for the Doors and Drawers

Although different filing cabinets 20 and 120 are shown, the latching and locking mechanisms for both are the same and separate reference characters will not be used for these mechanisms in the different cabinets.

C-1. Door Latch Bolt Mechanism

Although the door latch bolt mechanism 400 is identical for both different-type cabinets, either cabinet may be provided with a twist handle 401 or a pull handle 402 for operating the mechanism. The pull handle 402 as shown in FIG. III is recessed into a chamber 403 in the center of the front panel 311 of the door 310 while the twist handle 401 projects out from the face of the door as shown in FIG. I. The means for converting the pull handle 402 axially of the axis 405 being twisted to operate the lever 410 of the latch mechanism 400 comprises a crank means 406 (see FIG. III) on the end of a shorter shaft 405 with an offset finger 407 on the plate 408 of the handle 402, which plate 408 is mounted at its ends in pivots 409 in the recessed portion 403. Thus as the plate 408 of the pull handle 402 is pulled outwardly and raised to open the drawer 300 its rotation around the horizontal axis of the pivots 409 causes the finger 407 to push down the lever 406 to rotate the shaft 405.

Referring now to FIG. VIII, the shaft 405 has keyed to its inner end a centrally attached lever 410 having forked ends bridging or engaging pins 411 mounted on equal and oppositely slidable L-shaped bolt slides 415 which have complementary "L" leg sections extending along opposite sides of the shaft 405. Between the ends of this "L" leg sections and the base of the "L" legs on the other slide 415 are compression-type springs 416 for urging these slides 415 in opposite vertical directions. At the outer ends of these slides 415 adjacent the edges of the frame 315 of the door 310 and extending through the door frame apertures 316, there are antifriction plastic bolt extensions 417 which are affixed to the slides 415 by crimped-over flanges 418 and holes for pegs 419 formed in the plastic bolt extensions 417 (see FIG. VIII-A). Thus the antifriction tapered end latch bolts 417 are simply and rigidly attached to the L-shaped bolt slides 415, which slides are continuously urged in opposite directions into latching position with their keepers 77 in the door jamb frame 70 or 170. Thus with the two bolt latches 417 being continuously urged by the two springs 416 into their keepers 77, even if the cabinet is dropped so that the one of the bolts 417 might tend to be jarred from its keeper, the other associated oppositely urged bolt is further urged into its keeper for maintaining the doors of the cabinet closed. There are no separate spring mechanisms for mounting the bolts 417 on their slides 415 making this latch mechanism 400 much simpler and more positively locking than that shown in the above mentioned prior McClellan U.S. Pat. No. 2,750,901, upon which this invention is an improvement.

C-2. The Key Plunger and Combination Locks

A key plunger lock 430 is provided on at least one side of at least one of the plurality of the doors or drawers of the cabinet of this invention for operating the gang-locking mechanism 500 described in Section C-4 below. This key plunger lock 430 may contain a key operated bolt 431 engaging a (see FIG. X) keeper in the door formed in the channel or tube in which the plunger 430 operates. The inner end of this plunger 430 is provided with an extension 432 having an offset portion 433 forming a shoulder 434 which may be engaged by a plunger lock rod 446 connected to a combination lock 440. This combination lock 440 also may be provided on the door 310 with its dial 441 adjacent the plunger lock 430 as shown in FIG. III, but with its notched disc mechanism 442 and bolt 443 being behind the door (see FIG. IX also). This bolt 443 is shown in FIG. IX to be pivotally connected to one arm of a bell crank lever 445, the other arm of which is connected to a plunger lock rod 446 urged by a compression spring 447 into engagement behind the offset portion 433 and against the shoulder 434 of the key plunger lock 430. Thus when the key plunger lock 430 is in its locked or inserted position flush with the face of the door 310, the bolt mechanism 446 is in the position shown in FIG. XI to lock and maintain the plunger lock 430 in its locked position. An additional feature of this lock and lever mechanism on the combination lock 440 is that once the combination is used for rotating the dial 442 and opening the lock to move the bolt 443, it in turn retracts the bolt 446 so that the key plunger lock 430, if it is unlocked by the key, will be automatically released and pushed outwardly unlocking all of the gang-lock mechanism 500 of all the doors. The means for urging the plunger lock outwardly is usually by the springs which are in the drawer levers of this mechanism 500 as will be described below in Section C-4. As soon as the plunger 430 is pushed into its locked position again so that the bolt 446 can engage behind the stop 433 and against the shoulder 433, the spring 447 operates the bolt 443 of the combination lock to spin the discs and the dial 441 to remove automatically any indication of the last number of the combination of that lock 440 and mix up the setting of the discs in the mechanism 442, as well as relock the plunger 430.

C-3. The Supplemental Fusible Locks

Referring again to FIGS. III, there is shown at the opposite side of the door 310 from that of the combination lock 440, a further locking bolt mechanism 450 (see also FIG. III-A) which may comprise a bolt 451 normally urged by a spring 452 into a keeper 178 in the door jamb frame 170, but being retained from so locking the door 310 by either a fusible plate 455 over the end of the bolt 451 adjacent the keeper, or on a fusible washer 456 under the head of an extension rod 457 at the opposite end of the bolt 451 beyond the spring 452. When the fusible retaining means 455 or 456 is melted due to an abnormally high temperature outside the cabinet, such as in a fire, the bolt 451 is released to engage its keeper 455 and further lock the cabinet. One or more of such supplemental bolts 451 may be employed on each door 310 or 210 of the cabinet to engage the door jamb 170 or 270, respectively, to prevent warping of the door due to the fire, thus further securing the contents of the cabinet. These supplemental fusible locks also would be operated by any surreptitious entry into the cabinet by means of a blow-torch or other hot or heated tool.

C-4. The Drawer Gang-Locking Mechanism

Referring now to FIGS. I, X and XI, there are shown parts of the gang-locking mechanism 500 comprising a vertically movable locking bar 501 slidable along the one side of the rib 56 or 156 in the embodiments of FIGS. II and III, which locking bars 501 are held in position by a plurality of plates 510 which on one end are mounted in the lanced loops 58 or 158 on the strip 56 or 156 and on the other end on studs 59 welded to the inside panel 52 or 152 of the adjacent wall. Each of these plates 510, all of which are identical, contain slots 511 through which pins 502 or bar 501 protrude and are free to move throughout their vertical reciprocations with the vertical locking bar 501. Also mounted on each of these plates 510 is a single pivot 512 upon which are mounted two levers, namely; a locking pawl lever 520 and a bell crank lever 530 which levers are urged apart by a coil spring 525 wrapped around the pivot 512. Also mounted on the plate 510 is a horizontal reciprocating push rod 540 urged toward the plunger 530 by means of helical spring 541. A shoulder 542 on this push rod 540 engages one arm of the bell crank lever 530 and the other arm thereof has a forked end surrounding the pin 502 on the vertical locking bar 501. The spring-urged pawl lock lever 520 has a cam pawl end which can ride along the top of the rail 241 before it falls into its keeper aperture 243, in the event the drawer is open and all the rest of the doors are locked closed, so that the open drawer when it is closed will lock also. The other end of the pawl lock lever 520 engages the underside of the pin 502 and also engages a tab 531 on the lower fork of the bell crank lever 530 to insure unlatching of the drawer in the event no pin 502 is provided on the locking bar 501 at that drawer.

Thus when the plunger 430 is inserted so that its outer end is substantially flush with the outside of the door 200 or 300, the inner end of its plunger portion 433 engages the end of the plunger bar 540 on plate 510 to place it in the position shown at the top of FIG. X, which in turn moves the bell crank lever 530 so that the fork lever end thereof will raise the vertical stack bar 501 and correspondingly move all of the bell crank levers 530 at each of the other drawers into the same position. This also causes the locking pawl lever 520 to move into its drawer-locking position in keeper 243 as shown in FIG. X, urged thereby by the spring 525.

When the door 210 or 310 is open and/or the plunger 430 is unlocked so that it protrudes outwardly from the face of the drawer and its inner end is out of contact with the plunger 540, the spring 541 on the rod 540 on plate 510 moves the bell crank lever 530 into the position shown in FIG. XI forcing the bar 501 down through its engagement with the pin 502, and correspondingly positively raises each of the pawl levers 520 out of their keepers 243 into the position as shown in FIG. XI. It is to be understood that the tab 531 on the bell crank lever 530 has no effect if there is no plunger 540, and it is only of consequence in the event that the pin 502 has been removed from the bar to make the door completely independent of the other drawers and in the instance its associated door would require a key lock plunger 430 to cooperate with the plunger rod 540. Usually in cabinets for gang-locking there is only one plunger 430 on one of the drawers and thus there is no requirement for any other plungers 430 and 540 at any other doors. Therefore, most of the other drawers of the cabinet have plates similar to the one shown at the bottom half of FIG. X, provided there is one plate that has the plunger as shown in the top of FIG. X. Thus the other drawers are controlled completely for their locking and unlocking by the vertical reciprocation of the vertical locking bar 501.

It is to be clearly understood that a gang-locking mechanism 500 and its vertical locking bar 501 can be installed on either or both sides of the cabinet for doubly locking each of the drawers, if desired, in either type of cabinet according to this invention. Further, the vertical locking bar 501 may only extend to one or more other drawers instead of all the drawers, or a plurality of vertically aligned locking bars may be employed for separate groups of drawers with each vertical locking bar being controlled by one or more plunger locks which in turn may be locked by a key and/or a combination lock. Also, the vertical locking bar 501 may be removed and each drawer locked separately.

C-5. The Drawer Interlocking Mechanism

Referring now to FIGS. II, XII and XIII, there is shown a plural drawer interlocking mechanism 550 comprising a vertical reciprocal interlocking bar 551 parallel to the inside rib 156 (or 56) for the other side wall of the cabinet and held in position thereby by a plurality of plates 560, all of which are identical and installed one at each drawer. One side of these plates 560 are held in place by the lanced tabs 158 on the vertical panel rib 156, and their other sides are held by the studs 159 and the nuts thereon, so that they may be readily installed or removed, as desired. This is all similar to the vertical reciprocal locking bar 501 and plates 510 for the gang drawer locking mechanism described in the section C-4 above. In this instance, however, the vertical locking bar 551 may be urged downwardly by a spring 553 to normally maintain all of the drawers in their unlocked position provided all of the drawers are closed. However, as soon as one of the set of drawers is opened, the interlocking mechanism operates to prevent the operation of any of the rest of the drawers until that drawer that was opened is closed again, then any other drawer may be selected and opened.

The vertical interlocking bar 551 has pins 552 at each door or drawer which extend through slotted apertures 561 in each of the plates 560 permitting the free vertical reciprocation of the interlocking bar 551. Mounted on each of the plates 560 on separate pivots 562 and 563 on opposite sides of the slot 561 and the vertical reciprocating interlocking bar 551, are a bell crank lever 570 and a lock pawl lever 580. Also mounted on the plate 560 is a horizontal reciprocating plunger rod 590 urged by a spring 591 so that one end thereof will engage the inner face of the door 210 or 310, and having an intermediate shoulder 592 which engages one arm of the bell crank lever 570. The other arm of the bell crank 570 cooperates with the pin 552 on the vertical interlocking bar 551. The pawl lock lever 580 has a pawl cam latch on one of its arms from its central pivot which engages a keeper 343 adjacent the rail or slide 341 on the other side of the door from the gang-locking mechanism. The other end of this pawl lock lever 580 cooperates with the lower side of the pin 552 as does the bell crank lever 570. However, there is also provided a spring 575 wrapped around the pivot 563 and engaging a tab on the plate 560 to urge the pawl normally into its locking position so that any positive action on the locking bar must counteract the action of all the springs 575, and thus the reason for the additional spring 552 connected to the interlocking bar 551.

When all of the doors are closed, all of the horizontal plunger rods 590 are pushed in against their compressing springs 591 at each of the doors as shown in FIG. XIII so all the doors are unlocked by this interlocking mechanism 550 and any one can be opened. However, when one of the doors is opened as shown at the upper part of FIG. XII, its plunger 590 extends under the action of spring 591 and thus operates its associated bell crank lever 570 to engage pin 552 to raise the rod 551 and all of its pins 552, so that all of the closed doors are locked by their associated locking pawls 580. When the one drawer or door is opened, as the top drawer in FIG. XII, the rail 341 having the keeper is moved with the opening of the drawer a sufficient distance so that as soon as the bell crank lever 570 starts to move to raise the pins 552 into the position shown in the top of FIG. XII, the keeper 343 for the end of the pawl lever 580 has already moved beyond the bottom of the pawl end of the lever 580, so that the pawl end rides along the top surface of the rail 341 being urged against this rail by the spring 575. Correspondingly, as soon as this drawer is closed again, the lock pawl 580 is prevented from engaging its keeper 343 by the bell crank lever 570 being pushed by the horizontal rod 590 which permits lowering of the interlocking bar 551 and the unlatching of all the pawl levers 580 from their keepers 343 at all the doors.

A particular advantage of this interlocking mechanism 550 is in the wide drawer filing cabinet 120 which has its center of gravity more easily moved out of the cabinet when more than one of its drawers are opened, thus reducing the chance of the cabinet being tilted over. This is also a safety feature in that the cabinet and its drawers are quite heavy, and if it did tilt with more than one of its drawers open, it could bruise or crush part of a person that might be standing close to the cabinet.

It is to clearly understood that any one of the features described above can be interchanged between the drawers and cabinets disclosed. Also it is not essential that all of the features disclosed be employed in any one cabinet, although they may be, and the more features that are employed in one cabinet, the safer the cabinet is. Also the more ways in which the cabinet can be locked, requiring more people or more different number combinations and keys by which it can be opened, the better its contents are safeguarded. In this respect there could be placed a plunger key on each side of each drawer, together with a combination lock for it, and also a key lock on the twist handle for the latch mechanism. Thus in order to open the drawers which should all be interlocked and require that all the drawers be unlocked before any one can be opened, there could be as many as five different keys and number combinations for access for each drawer, and with a four-drawer filing cabinet, this could mean that as many as twenty separate individuals being required for getting into any one of the drawers of such a file cabinet. On the other hand, only a minimum of such devices may be employed which would involve one ganglocking mechanism with one key plunger lock without a combination lock, and preferably also for a wide or lateral drawer filing cabinet to have one interlocking mechanism to prevent the opening of more than one drawer at a time.

It also should be understood that other types and shapes of shells and panels for the cabinets than those disclosed may be used, and those described can be interchanged from one cabinet to another without departing from this invention. Furthermore, the method of mounting the door on the end of the drawer or the shape of the drawer pan may be changed and different types of drawer slides may be used without departing from the scope of this invention. Other and more adhesives and plastic parts may be used than those specifically described.

Thus, while there is described above the principles of this invention in connection with specific apparatus, it is to be clearly understood that this description is made only by way of example and not as a limitation to the scope of this invention.

I claim:

1. An insulated metal filing cabinet having a plurality of drawers, comprising:

(A) an outer metal shell of two side panels and a top panel with inner reverse flanges around their front edges and orthogonal reverse flanges around their rear edges, an inverted tray bottom whose sides are welded to the bottom edges of said side panels and a back panel having a flanged edge slidable into said orthogonal reverse flanges around the rear edges of said two side panels and said top panel, (B) a stepped metal jamb frame having a peripheral reverse flange seatable in said front inner reverse flange and held therein by an adhesive, said frame having a plurality of openings corresponding to the plurality of drawers in said cabinet, said openings being separated by tubular cross-members and said frame having keeper holes therein, (C) an inner metal shell of a U-shaped piece forming top, back and bottom panels with flanges around their edges, said back panel having a plurality of spaced horizontal ledge channels, two side panels each having two parallel vertical ribs with lanced tabs, the edges of said side panels being welded to said flanges of said top, back and bottom panels of said U-shaped piece, and to the inner edges of said jamb frame, and (D) a reinforced concrete insulation filling the space between said inner and said outer shells and said tubular cross-members of said jamb frame.

2. A cabinet according to claim 1 wherein said outer metal shell has its said two side panels and said top panel formed into a U-shaped piece of a single metal sheet.

3. A cabinet according to claim 1 wherein said inner reverse flanges on said outer shell and on said jamb frame have interfitting U-shaped cross-sections.

4. A cabinet according to claim 1 wherein said insulation contains glass fibers.

5. A filing cabinet having at least one drawer and having slides attachable between said cabinet and said drawer, said slides comprising:

(A) telescopic rail sections along opposite sides of said drawer with one end section of each telescopic section attachable to said drawer and the other end section of each telescopic section attachable to the inside of said cabinet, (B) an additional telescopic rail section along the bottom of said drawer and with one end section attachable to the bottom of said drawer and its other end section attachable to the inside of said cabinet, (C) means for fastening said drawer attachable sections of said additional rail and one of said side telescopic rails together, and (D) means for fastening said cabinet attachable sections of said additional rail and the same said one side telescopic rail section together.

6. A cabinet according to claim 5 wherein said fastening means comprises parallel L-channels.

7. A metal filing cabinet having a drawer comprising:

(A) a metal pan having two sides and bottom and separate attached end panels, the upper parallel side edges of said pan having generally U-shaped channels having a perforated base portion and at least one inwardly extending leg portion, and said channel being absent of the upper leg portion for a section adjacent the front end of said drawer, (B) a vertical follower having orthogonal antifriction plastic supporting T-shaped guides at opposite vertical side edges thereof slidable in said perforated side channels of said pan and held by said inwardly extending leg portion, but removable at the front end of said drawer where said upper leg portion section is absent, and (C) oppositely spring-urged centrally-pinchable bars slidable through said guides with ends normally seated in said perforations of said side channels.

8. A filing cabinet having at least one drawer, said drawer comprising a bottom, two parallel sides, and a pair of interconnected horizontal and vertical telescoping slides, each slide having a stationary section and a movable section, said stationary sections of said horizontal and vertical telescoping slides being attached to a first L-shaped channel member attachable to said cabinet, and said movable sections of said horizontal and vertical telescoping slides being attached to a second L-shaped channel member attachable to one side and the adjacent bottom of said drawer, whereby the horizontal and vertical telescoping slides are movable inwardly and outwardly to and from said cabinet as a unit affecting vertical and horizontal stability to said drawer.

9. An insulated metal filing cabinet having a drawer and a latching means for said drawer, said drawer comprising:

(A) a metal pan having two sides and bottom and separate attached end panels, (B) a front insulated door having a peripherally flanged front metal panel and a stepped metal frame welded to said peripheral flange of said front panel, said frame having flange means and screws for attachment to the front end panel of said pan, and having a central vertical cross-channel for a bolt mechanism, (C) said latching means comprising:

(1) handle means mounted on the front panel of said door, (2) a center pivoted lever means mounted in said vertical channel in said door frame, connected through said door to said handle means and oscillated thereby, (3) oppositely and separately spring-urged bolt slides reciprocable vertically in said vertical channel, and (4) plastic bolt means crimped to the outer end of each said bolt slides for engaging and disengaging keeper holes in said jamb frame.

10. A cabinet according to claim 9 wherein said bolt slides are urged by separate springs on each side of the pivot for said lever means.

11. A cabinet according to claim 9 wherein said handle means is a twist handle.

12. A cabinet according to claim 9 wherein said handle means is a pull handle in a recess in said door.

13. An insulated metal filing cabinet having at least one drawer, said drawer comprising:

(A) a metal pan having two sides and bottom and separate attached end panels, (B) a front insulated door having a peripherally flanged front metal panel and a stepped metal frame welded to said peripheral flange of said front panel, said frame having flange means and screws for attachment to the front end panel of said pan, and having a central vertical cross-channel for a bolt mechanism, and (C) supplemental spring-urged bolt locking means mounted in said door for cooperation with a corresponding keeper hole in the door jamb frame, said supplemental locking means having a fusible stop means for normally retaining said supplemental bolt locking means in its unlocked position and at a certain predetermined temperature releasing said supplemental bolt locking means to be moved by said spring into its keeper hole for locking said door.

14. A cabinet according to claim 13 including a plurality of said supplemental locking means on each door.

15. An insulated metal filing cabinet having a plurality of drawers, comprising:

(A) a cabinet comprising:

(1) an outer metal shell of two side panels and a top panel, an inverted tray bottom whose sides are welded to the bottom edges of said side panels, and a back panel, (2) an inner metal shell of top, back and bottom panels with flanges around their edges, said back panel having a plurality of spaced horizontal ledge channels, two side panels each having two parallel vertical ribs with lanced tabs, the edges of said side panels being welded to said flanges of said top, back and bottom panels, and (3) reinforced concrete insulation filling the space between said inner and said outer shells and said tubular cross-members of said jamb frame;

(B) each drawer comprising:

(1) a metal pan having two sides and bottom and separate attached end panels, (2) a front insulated door having a peripherally flanged front metal panel and a stepped metal frame welded to said peripheral flange of said front panel, said frame having flange means and screws for attachment to the front end panel of said pan, and (3) telescopic rail sections along opposite sides of said pan with one end section of each telescopic section attached to said pan and having a keeper slot, and the other end section of each telescopic section attached by said lanced tabs to said vertical ribs on said side panels and supported by said ledge channels on said back panel of said inner shell of said cabinet, (C) plural locking means for said drawers in said cabinet comprising:

(1) manual lock plunger means mounted for horizontal reciprocable movement along one side of and through the door of at least one of said drawers, (2) a locking bar vertically reciprocable in said inner shell of said cabinet adjacent a vertical rib adjacent said door and having removable pins projecting therefrom at each drawer door, (3) lever mounting plates for each drawer attached to the lanced tabs on said vertical rib adjacent said locking bar, each of said first plates supporting a common pivot for a bell crank lever and a pawl latch lever, and supporting a removable spring-urged horizontal rod engageable at one end with said lock plunger for at least said one drawer, said bell crank lever being operated by said rod to operate said first locking bar through its adjacent pin, and said pawl latch lever normally being spring-urged into locking position with its associated keeper slot on said drawer rail section and being retracted by a lug engageable with said bell crank lever via said pins on said locking bar, said rod, and said lock plunger.

16. A cabinet according to claim 15 including a combination lock having its dial mounted on said front panel of said door and its lock mechanism behind said door, a bell crank lever pivoted at one end to the bolt of said lock mechanism and at its other end to a spring-retractable bolt for engaging a locking shoulder on said manual plunger means to lock it in its locked position.

17. An insulated metal filing cabinet having a plurality of drawers, comprising:

(A) a cabinet comprising:

(1) an outer metal shell of two side panels and a top panel, an inverted tray bottom whose sides are welded to the bottom edges of said side panels, and a back panel, (2) an inner metal shell of top, back and bottom panels with flanges around their edges, said back panel having a plurality of spaced horizontal ledge channels, two side panels each having two parallel vertical ribs with lanced tabs, the edges of said side panels being welded to said flanges of said top, back and bottom panels, and (3) a reinforced concrete insulation filling the space between said inner and said outer shells and said tubular cross-members of said jamb frame;

(B) each drawer comprising:

(1) a metal pan having a U-shaped two sides and bottom and separate attached end panels, (2) a front insulated door having a peripherally flanged front metal panel and a stepped metal frame welded to said peripheral flange of said front panel, said frame having flange means and screws for attachment to the front end panel of said pan, and (3) telescopic rail sections along opposite sides of said pan with one end section of each telescopic section attached to said pan and having a keeper slot, and the other end section of each telescopic section attached by said lanced tabs to said vertical ribs on said side panels and supported by said ledge channels on said back panel of said inner shell of said cabinet, (C) plural locking means for said drawers in said cabinet comprising:

(1) an interlocking bar vertically reciprocable in said inner shell of said cabinet adjacent a vertical rib on the one side of said door and having pins projecting therefrom at each drawer door, and (2) lever mounting plates for each door attached to the lanced tabs on said vertical lanced rib adjacent said interlocking bar, each of said second plates supporting on separate pivots a pawl latch lever and a bell crank lever, and supporting a removable second spring-urged horizontally reciprocable rod engageable at one end with its associated closed door, said bell crank lever being operated by said rod to operate said interlocking bar through its adjacent pin, and said pawl latch lever normally being spring-urged into locking position with its associated keeper slot on said drawer rail section and being retracted by said pins on said interlocking bar when all the doors of said cabinet are closed.

18. A cabinet according to claim 17 wherein said interlocking bar has a spring to aid its operation against the action of said spring-urged pawl latch levers.

19. An insulated metal filing cabinet having a plurality of drawers, comprising:

(A) a cabinet comprising:

(1) an outer metal shell of two side panels and a top panel with inner reverse flanges around their front edges and orthogonal reverse flanges around their rear edges, an inverted tray bottom whose sides are welded to the bottom edges of said side panels, and a back panel having a flanged edge slidable into said orthogonal reverse flanges around the rear edges of said two side panels and said top panel, (2) a stepped metal jamb frame having a peripheral reverse flange seatable in said front inner reverse flange of said U-shaped piece and held therein by an adhesive, said frame having a plurality of openings corresponding to the plurality of drawers in said cabinet, said openings being separated by tubular crossmembers and said frame having keeper holes therein, (3) an inner metal shell of a U-shaped piece forming top, back and bottom panels with flanges around their edges, said back panel having a plurality of spaced horizontal ledge channels, two side panels each having two parallel vertical ribs with lanced tabs, the edges of said side panels being welded to said flanges of said top, back and bottom panels of said U-shaped piece, and to the inner edges of said jamb frame, and (4) a glass fiber reinforced concrete insulation filling the space between said inner and said outer shells and said tubular cross-members of said jamb frame;

(B) each drawer comprising:

(1) a metal pan having a U-shaped two sides and bottom and separate attached end panels, the upper parallel side edges of said pan having perforated channels, (2) a front insulated door having a peripherally flanged front metal panel and a stepped metal frame welded to said peripheral flange of said front panel, said frame having flange means and screws for attachment to the front end panel of said pan, and having a central vertical cross-channel for a bolt mechanism, the steps in said frame interfitting with the steps of said jamb on the front of the outer shell of said cabinet, (3) telescopic rail sections along opposite sides of said pan with one end section of each telescopic section attached to said pan and having a keeper slot and the other end section of each telescopic section attached by said lanced tabs to said vertical ribs on said side panels and supported by said ledge channels on said back panel of said inner shell of said cabinet, (C) plural locking means for said drawers in said cabinet comprising:

(1) handle means mounted on the front panel of said door, a center pivoted lever means mounted in said vertical channel in said door frame, connected through said door to said handle means and oscillated thereby, oppositely and separately spring-urged bolt slides reciprocable vertically in said vertical channel, and plastic bolt means crimped to the outer end of each said bolt slide for engaging and disengaging keeper holes in said jamb frame, (2) manual lock plunger means mounted for horizontal reciprocable movement along one side of and through the door of at least one of said drawers, (3) a first stack bar vertically reciprocable in said inner shell of said cabinet adjacent a vertical rib adjacent said door and having removable pins projecting therefrom at each drawer door, (4) first lever mounting plates for each drawer attached to the lanced tabs on said vertical rib adjacent said first stack bar, each of said first plates supporting a common pivot for a first bell crank lever and a first pawl latch lever, and supporting a first removable spring-urged horizontal rod engageable at one end with said lock plunger for at least one drawer, said first bell crank lever being operated by said first rod to operate said first stack bar through its adjacent pin, and said first pawl latch lever normally being spring-urged into locking position with its associated keeper slot on said drawer rail section and being retracted by a lug engageable with said first bell crank lever via said pins on said first stack bar, said first rod, and lock plunger, (5) a second stack bar vertically reciprocable in said inner shell of said cabinet adjacent a vertical rib on the other side of said door and having pins projecting therefrom at each drawer door, and (6) second lever mounting plates for each door attached to the lanced tabs on said vertical lanced rib adjacent said second stack bar, each of said second plates supporting on separate pivots a second pawl latch lever and a second bell crank lever, and supporting a removable second spring-urged horizontally reciprocable rod engageable at one end with its associated closed door, said second bell crank lever being operated by said second rod to operate said second stack bar through its adjacent pin, and said second pawl latch lever normally being spring-urged into locking position with its associated keeper slot on said other drawer rail section and being retracted by said pins on said second stack bar when all the doors of said cabinet are closed.

20. A cabinet according to claim 19 including an additional telescopic rail section with one of its end sections along the bottom of said pan and its other end section attached to the inner shell of said cabinet.

21. A cabinet according to claim 20 wherein the means for attachment of said additional telescopic rail section comprises an L-channel attached to one of said side telescopic rail sections.

22. A cabinet according to claim 19 including a vertical follower having orthogonal antifriction plastic supporting guides at opposite vertical side edges thereof slidable in said perforated side channels of said pan, and having oppositely spring-urged centrally-pinchable bars slidable through said guides with ends normally seated in said perforations of said side channels.

23. A cabinet according to claim 19 including support rails mountable above said sides of said drawer having predetermined perforations therein, and transverse half-height partitions with top rails having predetermined perforations therein and having hooks at the ends of said rails, said hooks seatable in the perforations of said support rails, whereby said rails are adjustable for supporting the notched ends of different preselected lengths of file hangers.

24. A cabinet according to claim 19 including a supplemental spring-urged bolt locking means mounted in said door for cooperation with a corresponding keeper hole in said jamb frame, said supplemental locking means having a fusible stop means for normally retaining said supplemental bolt locking means in its unlocked position and at a certain predetermined temperature releasing said supplemental bolt locking means to be moved by said spring into its keeper hole to further lock said door.

25. An insulated metal filing cabinet having a plurality of drawers, comprising:

(A) a cabinet comprising:

(1) an outer metal shell of an inverted U-shaped piece forming two side panels and a top panel with inner reverse flanges around their front edges and orthogonal reverse flanges around their rear edges, an inverted tray bottom whose sides are welded to the bottom edges of said side panels of said U-shaped piece, and a back panel having a flanged edge slidable into said orthogonal reverse flanges around the rear edges of said two side panels and said top panel of said U-shaped piece, (2) a stepped metal jamb frame having a peripheral reverse flange seatable in said front inner reverse flange of said U-shaped piece and held therein by an adhesive, said frame having a plurality of openings corresponding to the plurality of drawers in said cabinet, said openings being separated by tubular crossmembers and said frame having keeper holes therein, (3) an inner metal shell of a U-shaped piece forming top, back and bottom panels with flanges around their edges, said back panel having a plurality of spaced horizontal ledge channels, two side panels each having two parallel vertical ribs with lanced tabs, the edges of said side panels being welded to said flanges of said top, back and bottom panels of said U-shaped piece, and to the inner edges of said jamb frame, and (4) a glass fiber reinforced concrete insulation filling the space between said inner and said outer shells and said tubular cross-members of said jamb frame;

(B) each drawer comprising:

(1) a metal pan having a U-shaped two sides and bottom and separate attached end panels, the upper parallel side edges of said pan having perforated channels, (2) a front insulated door having a peripherally flanged front metal panel and a stepped metal frame welded to said peripheral flange of said front panel, said frame having flange means and screws for attachment to the front end panel of said pan, and having a central vertical cross-channel for a bolt mechanism, the steps in said frame interfitting with the steps of said jamb on the front of the outer shell of said cabinet, (3) telescopic rail sections along opposite sides of said pan with one end section of each telescopic section attached to said pan and having a keeper slot and the other end section of each telescopic section attached by said lanced tabs to said vertical ribs on said side panels and supported by said ledge channels on said back panel of said inner shell of said cabinet, (4) an additional telescopic rail section with one of its end sections along the bottom of said pan and its other end section attached to the inner shell of said cabinet, said attachment comprising an L-channel attached to one of said side telescopic rail sections, (5) a vertical follower having orthogonal antifriction plastic supporting guides at opposite vertical side edges thereof slidable in said perforated side channels of said pan, and having oppositely spring-urged centrally-pinchable bars slidable through said guides with ends normally seated in said perforations of said side channels;

(C) plural locking means for said drawers in said cabinet comprising:

(1) pull handle means mounted on the front panel of said door, a center pivoted lever means mounted in said vertical channel in said door frame, connected through said door to said handle means and oscillated thereby, oppositely and separately spring-urged bolt slides reciprocable vertically in said vertical channel, and plastic bolt means crimped to the outer end of each said bolt slide for engaging and disengaging keeper holes in said jamb frame, (2) manual key-lock plunger means mounted for horizontal reciprocable movement along one side of and through the door of at least one of said drawers, (3) a combination lock having its dial mounted on said front panel of said door and its lock mechanism behind said door, a bell crank lever pivoted at one end to the bolt of said lock mechanism and at its other end to a spring-retractable bolt for engaging a locking shoulder on said manual plunger means to lock it in its key-locked position, (4) supplemental spring-urged bolt locking means mounted in said door for cooperation with a corresponding keeper hole in said jamb frame, said supplemental locking means having a fusible stop means for normally retaining said supplemental bolt locking means in its unlocked position and at a certain predetermined temperature releasing said supplemental bolt locking means to be moved by said spring into its keeper hole, (5) a locking bar vertically reciprocable in said inner shell of said cabinet adjacent a vertical rib adjacent said door and having removable pins projecting therefrom at each drawer door, (6) first lever mounting plates for each drawer attached to the lanced tabs on said vertical rib adjacent said locking bar, each of said first plates supporting a common pivot for a first bell crank lever and a first pawl latch lever, and supporting a first removable spring-urged horizontal rod engageable at one end with said key-lock plunger for at least one drawer, said first bell crank lever being operated by said first rod to operate said locking bar through its adjacent pin, and said first pawl latch lever normally being spring-urged into locking position with its associated keeper slot on said drawer rail section and being retracted by a lug engageable with said first bell crank lever via said pins on said locking bar, said first rod, and said key-lock plunger, (7) a second spring-urged interlocking bar vertically reciprocable in said inner shell of said cabinet adjacent a vertical rib on the other side of said door and having pins projecting therefrom at each drawer door, and (8) second lever mounting plates for each door attached to the lanced tabs on said vertical lanced rib adjacent said interlocking bar, each of said second plates supporting on separate pivots a second pawl latch lever and a second bell crank lever, and supporting a removable second spring-urged horizontally reciprocable rod engageable at one end with its associated closed door, said second bell crank lever being operated by said second rod to operate said interlocking bar through its adjacent pin, and said second pawl latch lever normally being spring-urged into locking position with its associated keeper slot on said other drawer rail section and being retracted by said pins on said interlocking bar when all the doors of said cabinet are closed.

* * * * *

UNITED STATES PATENT AND TRADEMARK OFFICE

CERTIFICATE OF CORRECTION

PATENT NO. : 4,303,286

DATED : December 1, 1981

INVENTOR(S) : Ralph E. McClellan

It is certified that error appears in the above-identified patent and that said Letters Patent are hereby corrected as shown below:

Column 7, line 9, change "and" to - - or - -; line 49, change "and" to - - an - -. Column 9, line 12, after "other" insert - - end - -. Column 12, line 36, change "433" to - - 434 - -. Column 20, line 22, cancel "of said U-shaped piece".

Signed and Sealed this

*Eleventh* Day of *May 1982*

[SEAL]

*Attest:*

GERALD J. MOSSINGHOFF

*Attesting Officer*

*Commissioner of Patents and Trademarks*